US010403246B2

(12) United States Patent
Hendricks

(10) Patent No.: US 10,403,246 B2
(45) **Date of Patent: *Sep. 3, 2019**

(54) HAND ACTUATED TREMOLO SYSTEM FOR GUITARS

(71) Applicant: Predice D Hendricks, Little River, SC (US)

(72) Inventor: Predice D Hendricks, Little River, SC (US)

( * ) Notice: Subject to any disclaimer, the term of this patent is extended or adjusted under 35 U.S.C. 154(b) by 29 days.

This patent is subject to a terminal disclaimer.

(21) Appl. No.: 15/289,100

(22) Filed: Oct. 7, 2016

(65) Prior Publication Data

US 2017/0025104 A1 Jan. 26, 2017

Related U.S. Application Data

(60) Continuation of application No. 14/562,252, filed on Dec. 5, 2014, now Pat. No. 9,466,270, which is a division of application No. 14/107,190, filed on Dec. 16, 2013, now Pat. No. 8,907,188, which is a division of application No. 13/680,039, filed on Nov. 17, 2012, now Pat. No. 8,609,965, which is a continuation of application No. 12/950,547, filed on Nov. 19, 2010, now Pat. No. 8,314,317, which is a division of application No. 11/671,527, filed on Feb. 6, 2007, now Pat. No. 7,838,751.

(60) Provisional application No. 60/765,174, filed on Feb. 6, 2006.

(51) Int. Cl.
*G10D 3/14* (2006.01)
*G10D 3/04* (2006.01)

(52) U.S. Cl.
CPC ..... *G10D 3/146* (2013.01); *G10D 3/04* (2013.01)

(58) Field of Classification Search
CPC ..... G10D 3/146; G10D 3/04
See application file for complete search history.

(56) References Cited

U.S. PATENT DOCUMENTS 3,290,980 A * 12/1966 Fender ..... G10D 1/08 84/307
5,431,079 A * 7/1995 Bunker ..... G10D 3/146 84/313
7,838,751 B2 * 11/2010 Hendricks ..... G10D 3/04 84/313

(Continued)

*Primary Examiner* — Kimberly R Lockett
(74) *Attorney, Agent, or Firm* — Carlos R. Villamar; The Villamar Firm PLLC

(57) ABSTRACT

A tremolo device with a movable bridge, an adjustment device, and a support frame is implemented on an acoustic guitar, with features that can also be employed on an electric guitar or other stringed instruments. The movable bridge holds strings of the musical instrument in tension. The adjustment device, such as a tremolo bar, moves the bridge to change the tension of the strings. The support frame engages the bridge at a first area and engages the musical instrument at a larger second area. When the tremolo device is used, the support frame receives a force over the first area and transmits a corresponding force to the musical instrument over the larger second area, reducing the pressure that would be experienced by the musical instrument. The support frame also transmits string vibration received through the bridge to the instrument body to produce proper acoustic tones.

3 Claims, 25 Drawing Sheets

(56) References Cited

U.S. PATENT DOCUMENTS

| | | | | |
|---|---|---|---|---|
| 8,314,317 | B2 * | 11/2012 | Hendricks | G10D 3/04 84/312 R |
| 2006/0162528 | A1 * | 7/2006 | Kinoshita | G10D 3/04 84/298 |
| 2006/0219093 | A1 * | 10/2006 | Urbanski | G10H 3/185 84/731 |
| 2008/0148919 | A1 * | 6/2008 | LaMarra | G10D 3/04 84/307 |
| 2013/0291705 | A1 * | 11/2013 | Rose | G10D 3/146 84/297 R |

* cited by examiner

HAND ACTUATED TREMOLO SYSTEM FOR GUITARS

CROSS-REFERENCE TO RELATED APPLICATION

The present invention is a continuation of U.S. patent application Ser. No. 14/562,252 of Predice D. HENDRICKS, entitled "HAND ACTUATED TREMOLO SYSTEM FOR GUITARS," filed on Dec. 5, 2014, now allowed, which is a divisional application of U.S. patent application Ser. No. 14/107,190 of Predice D. HENDRICKS, entitled "HAND ACTUATED TREMOLO SYSTEM FOR GUITARS," filed on Dec. 16, 2013, now U.S. Pat. No. 8,907,188, which is a divisional application of U.S. patent application Ser. No. 13/680,039 of Predice D. HENDRICKS, entitled "HAND ACTUATED TREMOLO SYSTEM FOR GUITARS," filed on Nov. 17, 2012, now U.S. Pat. No. 8,609,965, which is a continuation application of U.S. patent application Ser. No. 12/950,547 of Predice D. HENDRICKS, entitled "HAND ACTUATED TREMOLO SYSTEM FOR GUITARS," filed on Nov. 19, 2010, now U.S. Pat. No. 8,314,317, which is a divisional application of U.S. patent application Ser. No. 11/671,527 of Predice D. HENDRICKS, entitled "HAND ACTUATED TREMOLO SYSTEM FOR GUITARS," filed on Feb. 6, 2007, now U.S. Pat. No. 7,838,751, which claims benefit of priority to U.S. Provisional Patent Application Ser. No. 60/765,174 of Predice D. HENDRICKS, entitled "HAND ACTUATED TREMOLO SYSTEM FOR GUITARS," filed on Feb. 6, 2006, the entire disclosures of all of which are hereby incorporated by reference herein.

BACKGROUND OF THE INVENTION

Field of the Invention

The present invention generally relates to musical instruments, and more particularly to hand actuated tremolo systems for use with acoustic guitars, with features that can also be used with electric guitars.

Discussion of the Background

Tremolo units are devices used to alter the pitch of a stringed musical instrument, such as a guitar, by changing the tension of the strings. Most embodiments of tremolo devices generally increase or decrease the tension of the strings when a lever, also known as a tremolo bar, moves a bridge that holds the strings in tension. In general, tremolo units have been exclusively designed for electric and semi-hollow body guitars. Though a useful and expressive tool for the electric guitarist, prior art tremolo devices designed for use with electric guitars are generally not compatible with acoustic guitars.

One type of tremolo has its roots in the Bigsby style of the 50's and 60's. The unit is fastened to the face of the guitar, and a large arm mounted on a tensioning spring governs an axle with six holes through which the strings pass. As the arm is depressed and the axle is turned, the tension and pitch of the strings is lowered. Variations on this format have recently been developed—some with axles that turn, others with tailpieces that slant forward. Some guitarists, however, find this style of tremolo too stiff for their liking.

The most common form for the tremolo is that found in the Stratocaster style of electric guitar. A large metal block through which the strings pass and terminate has a lever on top and springs on bottom. Six individual height (intonation) adjustment saddles are poised on top. The springs provide offset tension to counteract the pull of the strings. The steel bar sets into the block, and by rocking the bar, one can change the tension and the corresponding pitch of the strings.

Prior art tremolo devices, such as those described previously, however, are designed for electric guitars and are generally not compatible with acoustic guitars. Standard construction of prior art tremolo devices generally involves a bridge plate of a metal material that differs greatly from the porous, wooden material necessary to produce acceptable acoustic guitar tone. As can be appreciated, the sound produced by a standard acoustic guitar is significantly influenced by the manner in which the strings make contact with the fixed bridge of the guitar, as well as by the materials from which the fixed bridge is made. Prior art tremolo systems are not capable of transferring the vibration of the acoustic guitar strings through the bridge plate in a manner consistent with the production of acceptable guitar tone. Thus, the prior art metal device used with acoustic guitars would alter the sound of an acoustic guitar in an undesirable manner.

Moreover, the prior art method for attaching tremolo devices to an electric guitar makes them inappropriate for acoustic guitars. Threaded screws at least ½ inch in length go into the top surface of a solid body guitar as anchors for the standard tremolo device base plate. The string saddles are held against the top surface of the metal bridge plate by string tension and by a screw through each saddle. The screws, which are perpendicular to the top of the guitar body, must resist the full tension of the strings as well as remain upright against the rocking motion of the tremolo bridge when the device is in use. In a solid body guitar, enough wood surrounds the screws to allow mounting and use of the tremolo device without damage to the body of the instrument. Attaching a tremolo device to an acoustic guitar in the manner disclosed in the prior art with respect to electric guitar would place excessive stress on the top sound board. As referenced in Machinery's Handbook, 21$^{st}$ Edition, under "Permissible Working Stresses for Structural Timbers (U.S. Government Tests)," spruce (the type of material widely used for acoustic guitars) has the ability to withstand compression of 250 PSI perpendicular to the grain of the timber. With the thickness required for acoustic guitars, ⅛ inch or less, spruce, with this compression rating, is unable to support the screws necessary for mounting a tremolo device of an electric guitar without severe damage to the top sound board of an acoustic guitar. Further, the spruce top cannot resist the combined stress of 400 lbs. of tension placed against the mounting screws by the strings. It is unable to support the screws necessary for mounting such a tremolo device without severe damage to the top sound board of an acoustic guitar.

Another problem with tremolo devices, such as the Stratocaster style tremolo device, is an inability to return to the same tension and remain in tune after the tremolo device has been used. There are many factors in how a guitar returns to tune after use of a tremolo device. For instance, the strings must not grab in the nut slots or on the bridge saddles, or the breaking angle of the string over the nut must be correct. Guitarists may work around this retuning problem by using the tremolo lightly, using it only for the last song of a set, or adjusting the balance of the strings and the springs. Meanwhile, some manufacturers employ features such as rollers for saddles and nuts to minimize the chances that the strings will catch. In the last few years, a couple of locking mechanisms have been introduced on the tremolo. They all feature locking bridge saddles and locking nuts. However, such techniques require patient initial tuning to keep a guitar in tune during a lot of abuse.

SUMMARY OF THE INVENTION

Therefore, there is a need for a tremolo system practicable for use with acoustic guitars, which also solves the noted problems with tremolo systems for electric guitars. The above and other problems are addressed by the exemplary embodiments of the present invention, which provide an improved tremolo system practicable for use with acoustic guitars and which includes features that can also be used with electric guitars. The tremolo system of the exemplary embodiments can be used with an acoustic guitar and allows the player to raise or lower the pitch of notes and full chords creating a vibrato effect of equal pressure on all strings. This technique expands the tonal horizons of the acoustic guitar and the creativity of the guitarist. Advantageously, the exemplary embodiments eliminate undue stress on the guitar's hollow body, thus, maintaining its structural integrity and providing true tonal and resonance qualities. In addition, the exemplary embodiments preserve the appearance of the acoustic guitar, which can be appreciated by traditional players. Furthermore, various features of the exemplary embodiments can be used with electric guitars.

Accordingly, in an exemplary embodiment of the present invention, there is provided a tremolo device with a movable bridge, an adjustment device, and a support frame. The movable bridge is positioned on the musical instrument, such as an acoustic guitar, and adapted to hold strings of the musical instrument in tension. The adjustment device, such as a tremolo bar, is adapted to engage the bridge and to move the bridge to change the tension of the strings. The support frame is adapted to engage the bridge at a first area and to engage the musical instrument at a second area. When the tremolo device is used, the support frame receives a force, from movement of bridge, over the first area and transmits a corresponding force to the musical instrument over the second area. Because the second area is greater than the first area, the pressure received by the musical instrument is less than the pressure received from the bridge, reducing the stress that would be experienced by the body of the musical instrument. Moreover, the contact between the support frame and the musical instrument through the second area provides a mechanism by which string vibration received through the bridge can be transferred to the instrument body. The musical instrument may have an internal cavity, and the support frame may be positioned within the cavity. The second area on the support frame may engage one or more interior walls of the cavity. The movable bridge may be positioned over an opening in body of the musical instrument. The movable bridge may move to change the tension of the strings by pivoting at a side of the body opening with the opposite edge of the movable bridge moving in and out of said internal cavity. Moreover, the movable bridge may pivot at pivot posts that also engage the support frame, so that the support frame can resist the force at the pivot post and reduce the stresses on the body of the musical instrument.

Another embodiment of the present invention is a tremolo device with a movable bridge, an adjustment device, and a stabilizer unit. The movable bridge is adapted to hold the strings of a musical instrument, such as an acoustic guitar, in tension. The adjustment device, such as a tremolo bar, is adapted to engage the bridge and to move the bridge to change the tension of the strings. The stabilizer unit is also adapted to engage the bridge and to restrict movement of the bridge caused by the adjustment device. The stabilizer unit may fix the movable bridge in one position to prevent any change in the string tension. The stabilizer may be used to return the bridge to a preset fixed position, particularly corresponding to a desired tuning. Moreover, the stabilizer unit may allow limited movement of the adjustment device, for example, in a single direction. The forces exerted by the stabilizer unit may be received by a support frame.

Yet another embodiment of the present invention employs a movable bridge, an adjustment device, and a housing. The movable bridge is adapted to hold strings of a musical instrument, such as an acoustic guitar, in tension. The adjustment device, such as a tremolo bar, is adapted to engage the movable bridge with one end and to move the bridge to change the tension of the strings. The housing is adapted to form a socket in the bridge and to secure the second end of the adjustment device with a lock. The second end of the adjustment device is positioned longitudinally in the housing and the lock is positioned transversely in the housing to engage the second end. The lock may include a contact piece held against the adjustment device with a screw and spring to keep the adjustment device fixed in the socket. Moreover, the movable bridge may have oppositely facing top and bottom surfaces and may receive the housing in an opening, where an outer lip extending from the housing abuts an area on the top surface around the opening, and where a washer engages the housing and abuts an area on the bottom surface around the housing opening.

A further embodiment of the present invention employs a movable bridge to hold strings of a musical instrument in tension, where the movable bridge has a string holding portion shaped to have a slot to receive each of the strings in tension. The strings are fixed at a first end to a distal part of the musical instrument. The strings have a middle portion with a first width and a second end with a second width, where the first width is smaller than the slot width and the second width is larger than the slot width. The strings are positioned in the slots at the middle portions and the second ends engage the bottom surface of the string holding portion.

Still other aspects, features, and advantages of the present invention are readily apparent from the following detailed description, by illustrating a number of exemplary embodiments and implementations, including the best mode contemplated for carrying out the present invention. The present invention is also capable of other and different embodiments, and its several details can be modified in various respects, all without departing from the spirit and scope of the present invention. Accordingly, the drawings and descriptions are to be regarded as illustrative in nature, and not as restrictive.

BRIEF DESCRIPTION OF THE DRAWINGS

The embodiments of the present invention are illustrated by way of example, and not by way of limitation, in the figures of the accompanying drawings and in which like reference numerals refer to similar elements and in which:

FIG. 3A illustrates a top view of the stabilizer showing the radius of the stabilizer arm, which way it turns, and the different positions it can be set in;

FIG. 4C illustrates the stabilizers shaft showing where the screw goes down through the middle and showing the recessed ends to where the stabilizers knob and arm fit in;

FIG. 4F illustrates a top view of the stabilizers knob and arm and the shaft showing where the screw fits in;

DETAILED DESCRIPTION OF THE PREFERRED EMBODIMENTS

The exemplary embodiments include the recognition that guitar players strive to create more expressive chord passages, licks, and runs, and develop more creative and advanced playing techniques. Accordingly, the present invention provides a tremolo device that is compatible with at least an acoustic guitar.

Figure 1A:
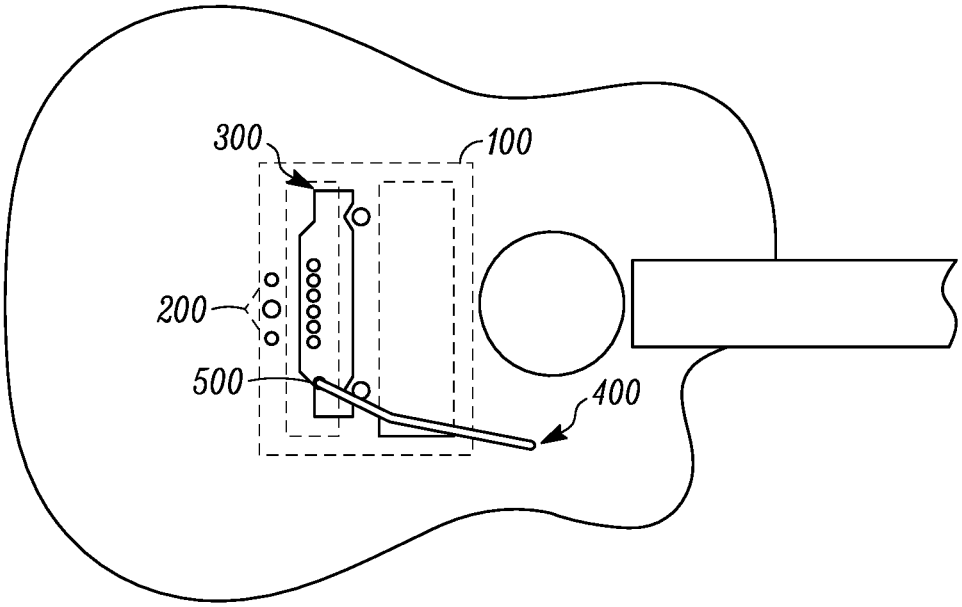
FIG. 1A illustrates a perspective top view of an acoustic guitar showing the location of where the preferred embodiment of the present invention is affixed.

In particular, embodiments of the present invention provide a support frame assembly that permits a tremolo device to be mounted on an acoustic guitar. An exemplary embodiment of the present invention includes a bridge, a tremolo bar, and a support frame with a generally rectangular shape. As shown in FIG. 1A, the support frame assembly 100 is installed inside the hollow cavity of an acoustic guitar body, just underneath the bridge area, providing a solid manner of affixing the system to the guitar, as well as providing structural support when the system is in use.

Figure 1B:
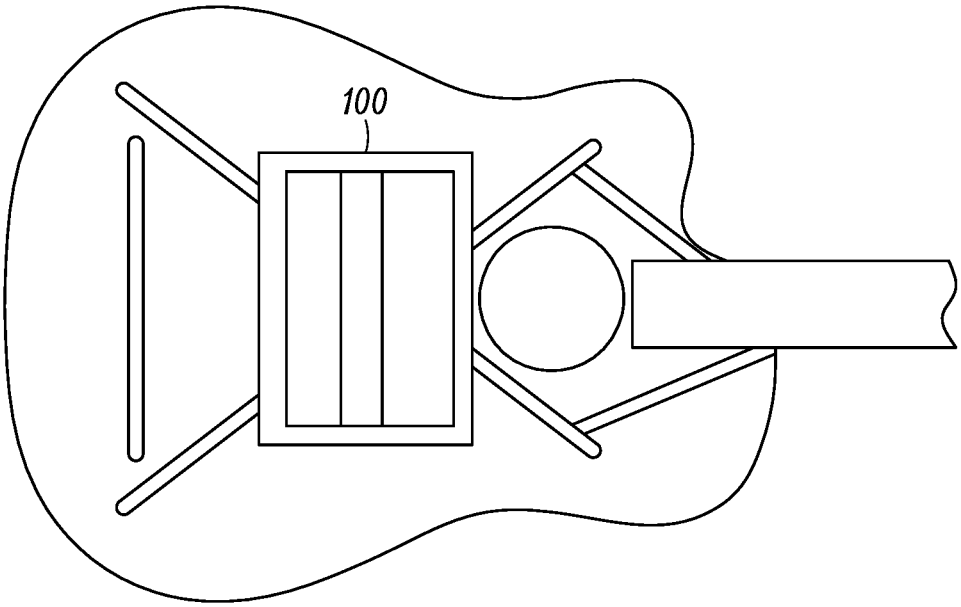
FIG. 1B illustrates a view of the guitar flipped upside down with the back off to show how the preferred embodiment of the present invention butts up against the sound braces inside the guitar.
Figure 1C:
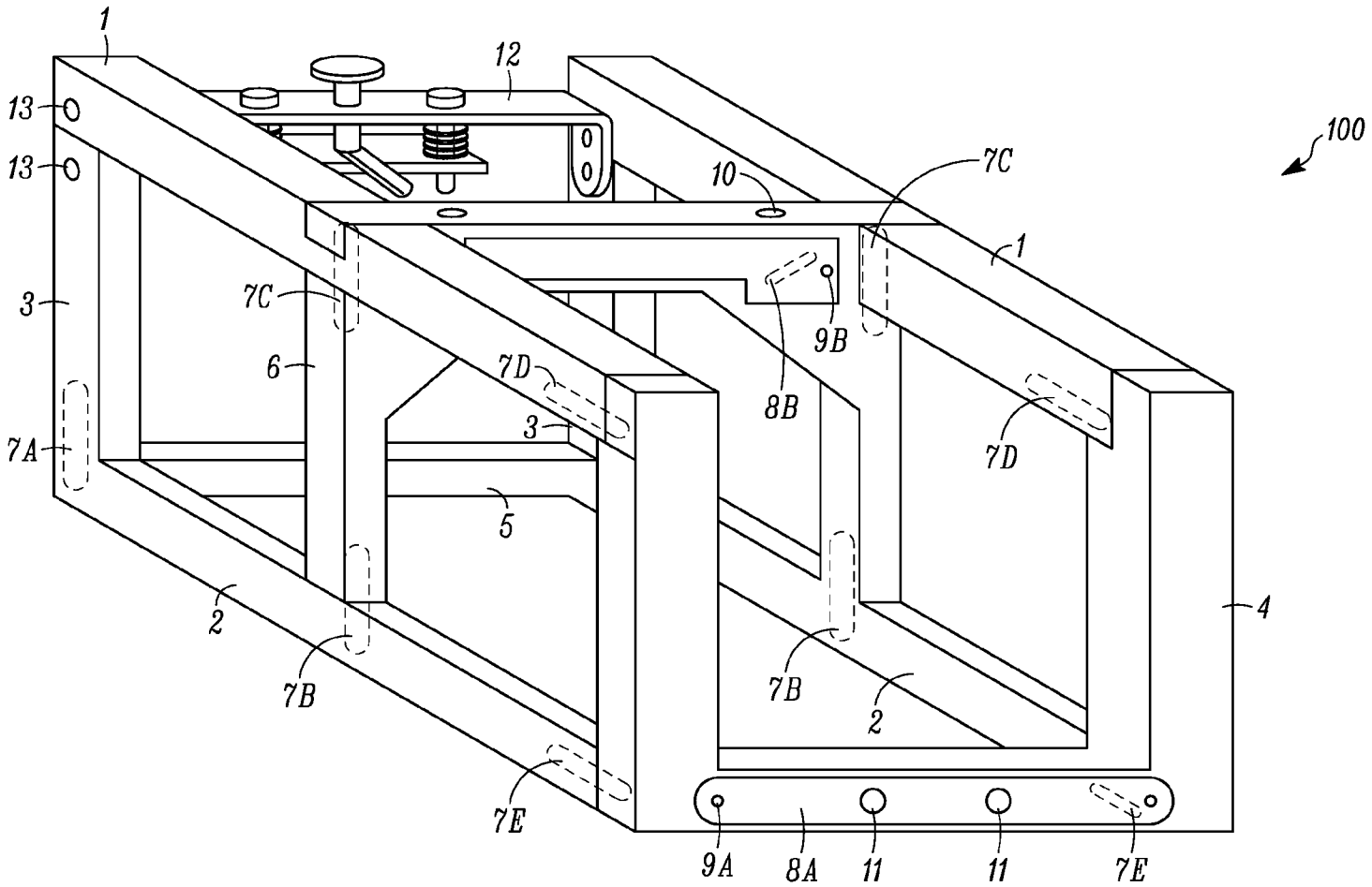
FIG. 1C illustrates a three-dimensional diagram showing the front, sides, and top view of the preferred embodiment of the present invention support frame assembly.

In accordance with this exemplary embodiment, a wooden top bridge plate 30 (FIG. 7) is connected to a metal base plate 25 (FIG. 8), forming a movable bridge 300 (FIG. 1A) over an opening in the body of the guitar. The movable bridge 300 is attached to the wooden support frame assembly 100 located inside the hollow cavity of the guitar. As shown in FIG. 1C, a cross brace 6 on the support frame 100 has a pair of bridge pivot posts 10 to allow for secure attachment of the bridge 300 to the guitar. The support frame 100 is of sufficient strength to receive the forces and tension created by the strings when the tension of the strings is raised and lowered to provide the desired tremolo effect. The forces applied to the top by the tension of the strings is applied to the entire surface area where the support frame 100 engages the guitar body, thus spreading the force over an area of sufficient size to withstand the tension without causing the top to fail. The support frame 100 may be completely assembled prior to installing it in the guitar body. As shown in FIG. 1B, the support frame 100 may be glued into place inside the sound box of the acoustic guitar, directly beneath the area where the tremolo is affixed. This operation can be performed before the back of the guitar is attached during the production of the instrument.

Moreover, the wooden frame support assembly 100 provides acceptable guitar tone, because it is in contact with two surfaces of the guitar, thus transmitting vibration from the bridge 300 to the guitar body. The top of the sound box of the acoustic guitar is constructed from spruce or other similar soft wood in a thickness of no greater than ⅛ inch. When properly supported by suitable braces located on the underside of the top, spruce or other similar soft wood is able to withstand upwards of 200 lbs of pull exerted by the strings at the site of a standard fixed bridge. In particular, as shown in FIG. 1B, the support frame 100 abuts several braces glued to the underside of the top sound board, transferring string vibration from the tremolo bridge 300 through the support frame 100 and throughout the guitar body to the top and bottom sound boards.

Embodiments of the present invention also provide a stabilizer unit 200 (FIG. 1C) that offers the player at least three different bridge tension settings, as well as quick and easy alternate tuning settings. The stabilizer unit 200 is mounted to the support frame 100. The stabilizer 200 can be designed to offer the player three different bridge tension settings as illustrated in FIG. 3A: a fixed bridge A (a bridge that does not move); a standard bridge B (one that only moves down); and a floating bridge C (one that allows movement down and up).

Figure 3A:
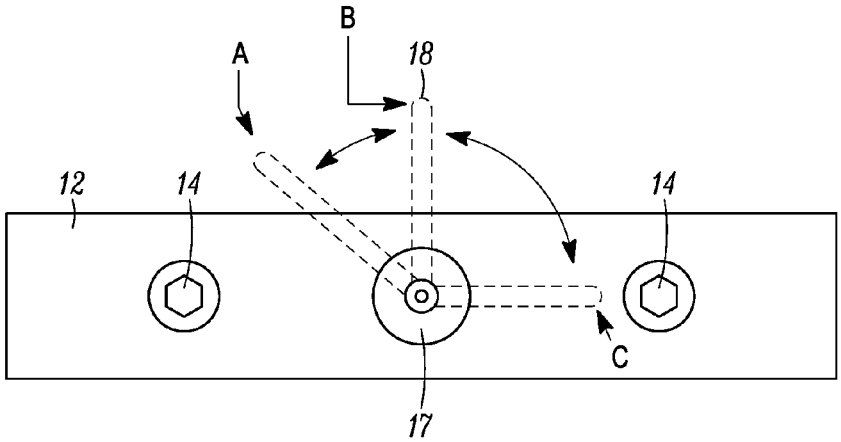
Figure 3B:
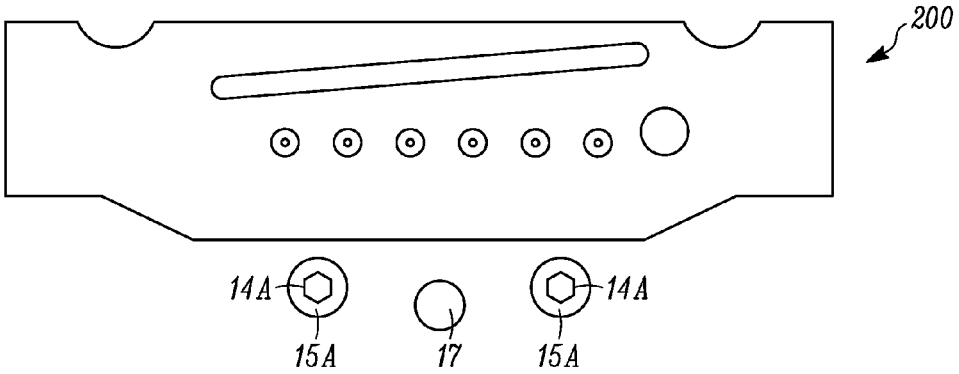
FIG. 3B illustrates a bridge showing the optional height adjustment knobs that can be used instead of the screws.
Figure 3C:
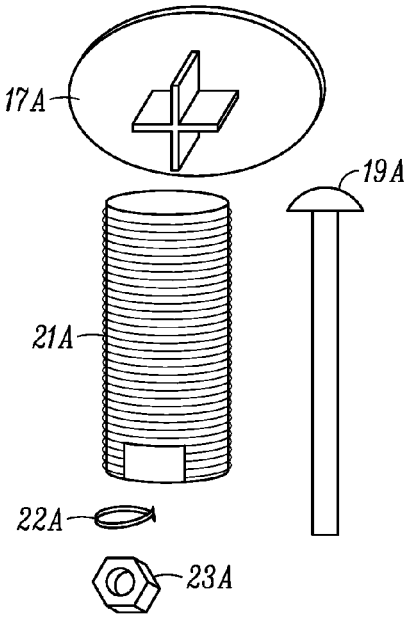
FIG. 3C illustrates a knob configuration similar to that used in the stabilizer knob arms setup.

To correct the problem of out-of-tune strings when a string breaks, the stabilizer arm 18 can be positioned in the standard position B, as shown in FIG. 3A, allowing the bridge 300 to rest on the stabilizer arm 18 which is pre-positioned to standard tuning. When the guitar is properly tuned and stabilizer 200 is preset, the guitarist can quickly and easily compensate for a broken string during a song by pressing lightly on the tremolo bar 400 to release the tension on the strings and then swinging the arm 18 of the stabilizer 200 around to reset the bridge 300. A broken string causes the tension of the remaining strings to change because the strings are attached to bridge 300 which is held in opposing tension by the springs 37 (FIG. 9A) of the tremolo device described hereinafter. The player can go right back into playing and finish the song without missing but a second or two of playing. Advantageously, this eliminates the need of changing guitars during a song, retuning, or having to stop the song, which can be particularly useful in live performances.

In addition, it has been discovered that when the tremolo bar 400 is not in stable engagement with the bridge 300, the tremolo bar 400 may swing out of place or wobble when used. Some devices screw one end of the tremolo bar into a threaded socket, but this method may not provide a tight fit if the tremolo bar is not sufficiently rotated into the socket or if the bar starts to back out. Other prior art devices employ plastic clips which are supposed to create a tight fit, but such clips are prone to wear with the passage of time, causing a loosening of the fit. Thus, to solve the problems of the prior art, embodiments of the present invention provide a housing 500 (FIGS. 9A-9B) to secure the tremolo bar 400 to the bridge 300 and to prevent the tremolo bar 400 from being unstably fixed to the bridge 300. As shown in FIG. 9B, the housing 500 provides a socket 29 in the bridge 300 into which the tremolo bar 400 is inserted. This embodiment provides a spring loaded piece F (FIG. 9B) creating a constant tension on the tremolo bar 400 to create stable engagement between the tremolo bar 400 and the bridge 300.

Figure 8:
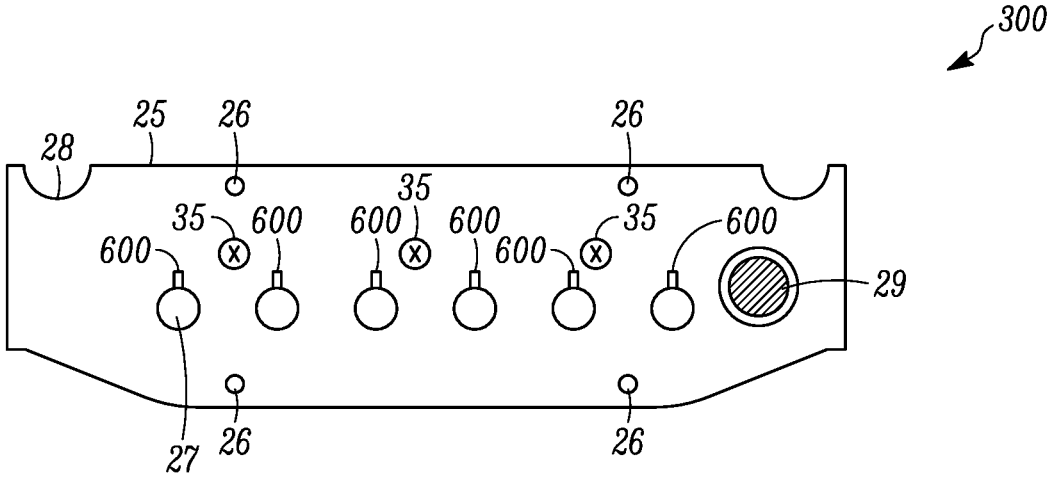
FIG. 8 illustrates a top view of the metal bridge plate showing the customized string slots that holds the strings in place, the housing for the tremolo bar, and the screws that hold the bridge in place.

Furthermore, embodiments of the present invention prevent the guitar from becoming out of tune by employing string slots 600 to lock the strings and to prevent the strings from slipping. As illustrated in FIG. 8, proper tuning is retained after the tremolo device is used due to the manner in which the balls of the strings (devices capping the end of the strings) are anchored. The bridge 300 has string holes 27 which are perpendicular to the bridge surface. When the strings are positioned "downwardly" into the string holes 27, each string slides into a slot 600 extending radially from the outer edge of the string hole 27. The ball of each string is positioned "below" the slot. Because the width of the slot is less than the width of the ball, the ball cannot move "upward" into the slot. Thus, when there is tension pulling "upward" on the strings, the ball contacts the edges of the "lower" surface of the slots, resisting the "upward" pull. A pin is placed in the string holes to wedge the strings in the holes, but the contact between the balls and the edges of the slots prevents the strings from slipping and changing the tension and tuning. Proper tuning may be further retained by using LSR Roller Nut and Sperzel Locking Tuners.

Referring now to FIGS. 1A-10, there is illustrated an exemplary tremolo system, including an internal support frame assembly 100 (FIG. 1A) that can be produced from wood and features a rectangular design. In other embodiments, structures other than rectangular structures and materials other than wood can be employed, as will be appreciated by those skilled in the art. For example, any suitable composite, plastic, or like materials can be employed, and so that the natural acoustic resonance qualities of the acoustic guitar are preserved.

As shown in FIG. 1C, the top parallel supports 1 are joined to vertical supports 3 at their ends. At the bottom of the rear vertical supports 3, each side is joined together with glue on top of the bottom parallel supports 2 at Dowel rod area 7A. The horizontal support member 5 is glued to each side of the rear bottom parallel supports 2. At the top of each side both the top parallel supports 1 and rear vertical supports 3 are drilled through and two screws and bolts 13 are placed through each side to hold the stabilizer bracket 12 in place. The top parallel supports 1 are notched to recess the central cross member 6 in the middle, and are glued together at Dowel rod area 7C. The bottom of the central cross member 6 sets on top of the bottom parallel supports 2 and is glued together at Dowel rod area 7B. The front U-brace 4 can be one complete piece notched on top to allow the top parallel supports 1 to rest and be secured at Dowel rod area 7D. The bottom parallel supports 2 butt and are secured at the backside of the front U-brace at Dowel rod area 7E. This area keeps the tremolo claw 40 (FIG. 10) and spring assembly 37 (FIG. 9A) in tension. A thin metal strip 8A (FIG. 1C) is attached by two tiny screws 9A onto the face of the front U-brace 4 for needed additional support. Another thin metal strip 8B (FIG. 1C) is attached to the central cross member 6 by two tiny screws 9B for additional support in this area as well. Two Allen wrench screws 11 are accessible through the guitars sound hole for adjustment of the spring assembly's tension, which is attached to the claw 40 (FIG. 10). The claw 40 has the threaded screw holes 42, into which the Allen wrench are screws recessed, and the teeth 41, which attach to the springs 37 (FIG. 9A) of the claw 40. Prior to installing the springs 37, the preferred embodiment of the present invention utilizes a rubber hose sleeve around the springs 37. However, the material used is not limited to the use of rubber but, for example, can use plastic or any other suitable material instead. Advantageously, this buffers the sound of the springs allowing a smoother sound when the tremolo is being used.

Figure 6:
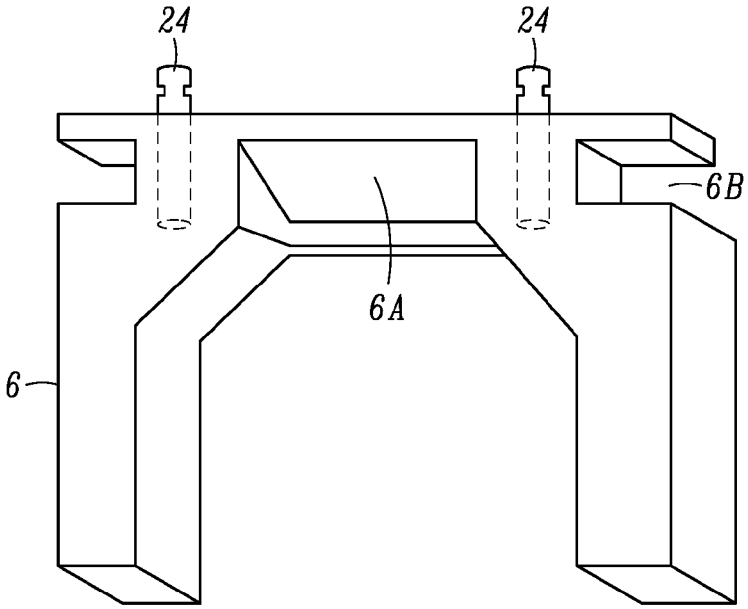
FIG. 6 illustrates a rear view of the central cross member of the frame assembly, showing the recessed angle cut, which allows movement of the block when the tremolo bar is being used.

The central cross member 6 being one complete piece in the shape of an "n", has a notch 6B (FIG. 6) to receive the top parallel supports 1 that rest on top of the central cross member 6. They are connected and secured at Dowel rod area 7C (FIG. 1C). Two holes 10 (FIG. 1C) located on the top of the central cross member 6 house the pivot posts 24 (FIGS. 5-6) that align with the curved half-moon cuts at the bridge area 28 (FIGS. 7-9A) on the guitar surface. This allows the wooden bridge plate 30 (FIG. 7) and the metal bridge plate 25 (FIGS. 8-9A) to engage the support frame 100 (FIG. 1C) located within the guitar body. The front view of the central cross member 6 (FIG. 5) shows the housing and pivots 24 that are inserted through the guitar body and into the central cross member 6 (FIG. 1C). FIG. 6 is the rear view of the central cross member showing the 22½ degree angle cut 6A that gives the clearance to the block so that when the tremolo bar 400 is pulled back to raise the pitch, it gives the room necessary to allow the block to move freely and give the player a floating bridge when desired. Once the exemplary support frame assembly 100 is assembled, the Dowel rod areas (7A-7E) are drilled and small Dowel rods, milled from hardwoods using conventional mill working techniques, are glued firmly into the mating holes for additional strength so the preferred embodiment of the present invention is able to withstand the stresses exerted upon it. The embodiment described herein uses glue, but the present invention is not limited to the use of adhesives. Mechanically interlocking parts or fastening devices can be used, for example. The exemplary tremolo system is not limited to the use of dowel rods, as other means, such as screws, can be used to secure the support frame assembly 100 together.

Figure 2:
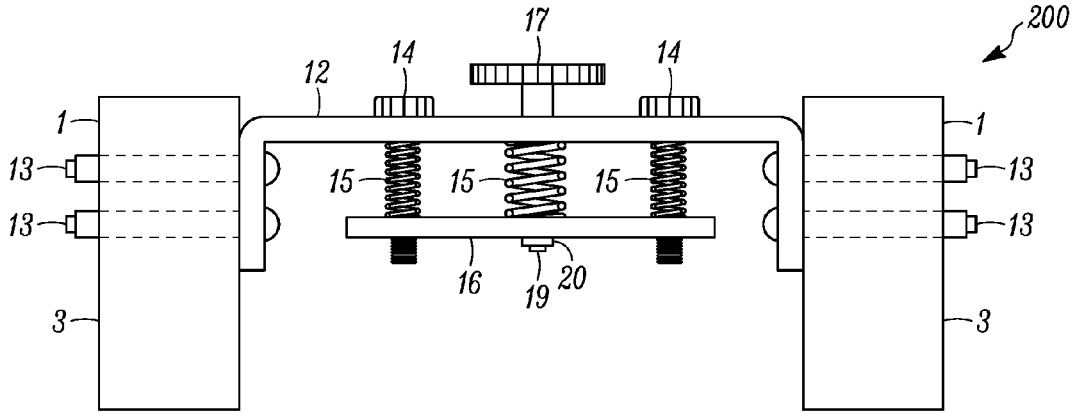
FIG. 2 illustrates a diagram showing the details of how the stabilizer is built, and how it attaches to the rear of the preferred embodiment of the present invention frame assembly.
Figure 4A:
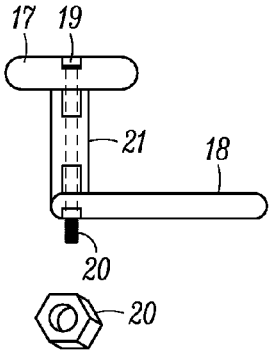
FIG. 4A illustrates a side view of the stabilizer and arm showing how the screw fits through and how the shaft (center cylinder) piece is recessed to except the knob on top and arm on the bottom.
Figure 4B:
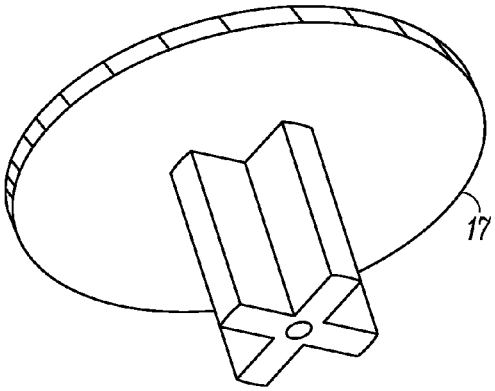
FIG. 4B illustrates the stabilizer knob showing the male cross end piece that recesses into the shaft.
Figure 4C:
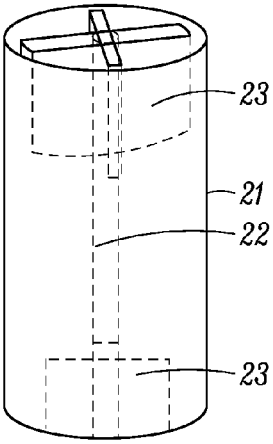
Figure 4E:
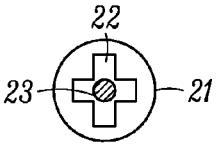
FIG. 4E illustrates a top view picture of the shaft showing the screw hole going down through the middle and the crossed recess area.
Figure 4F:
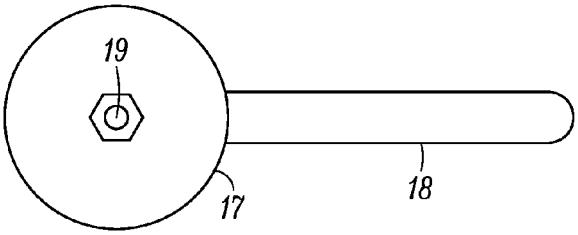
Figure 4G:
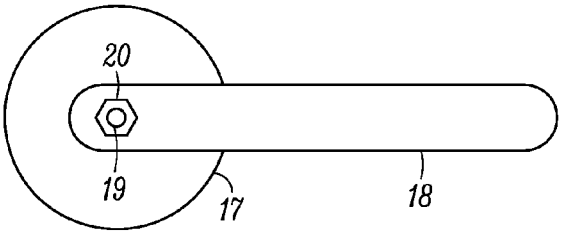
FIG. 4G illustrates a bottom view of the stabilizers knob and arm showing how the screw is secured.
Figure 4D:
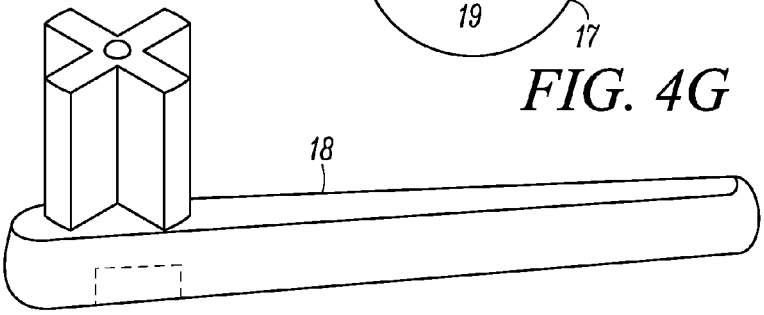
FIG. 4D illustrates a the stabilizer arm showing the male cross end piece that recesses into the shaft.
Figure 5:
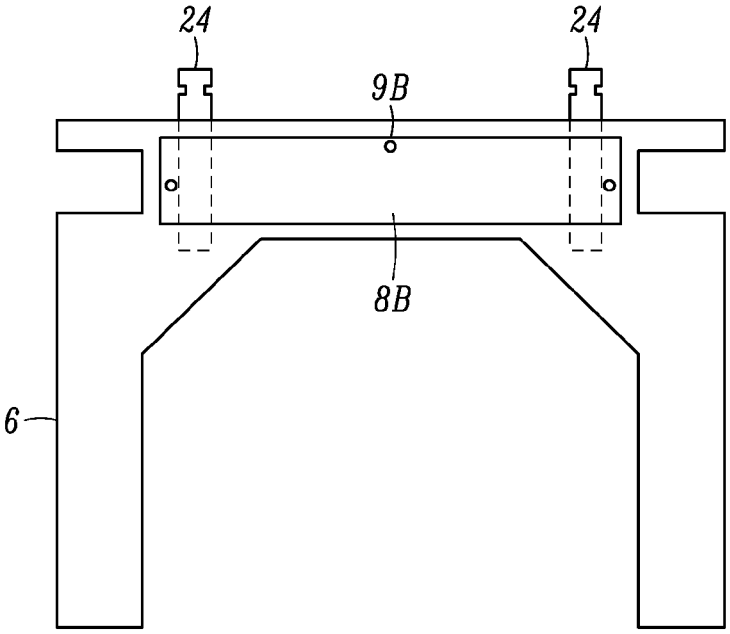
FIG. 5 illustrates a front view of the central cross member of the frame assembly, showing the metal bracket attached to the face, and showing where the pivot posts screw into the housing unit, which is recessed into the central cross member.

The stabilizing unit shown in FIG. 2, can include a metal bracket 12 bent at 90 degrees on each end to be attached to both the top supports 1 (FIG. 1C) and rear supports 3 and secured with two screws and bolts 13 on each end. Two height adjustment screws 14 (FIG. 2) are fed down through the bracket 12 and springs 15 and attached to the bottom plate 16. This allows the height of the stabilizer adjustment arm 18 (FIG. 3A, 4A) to be set by threading the screws 14 into the stabilizer adjustment plate 16 (FIG. 2), which also houses the stabilizer arm 18 and knob 17. A screw 19 (FIG. 2) is placed down through the stabilizer knob 17 with a male end on it (FIG. 4B) that fits into the top recessed area 23 (FIG. 4C) of the shaft (FIG. 4C). The shaft 21 (FIG. 4C) is recessed on both ends in the shape of a cross 23 to interlock so when you turn the knob (FIG. 4B), it prevents slippage or unnecessary turning. A hole 22 (FIG. 4C) extends down through the stabilizer bracket 12 (FIG. 2), to the adjustment plate 16. The screw 19 (FIG. 2) and is secured with a bolt 20 on its end. It is preferred that a lock washer to be used for security.

Figure 3D:
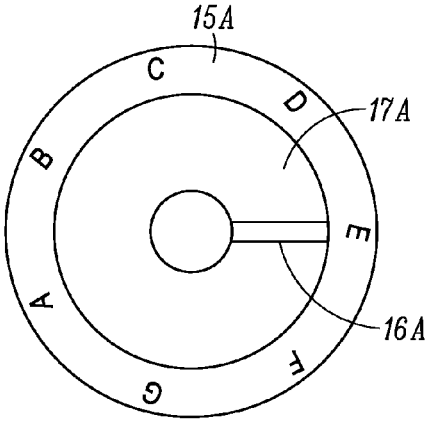
FIG. 3D illustrates a top view of what the knob of FIG. 3C, showing the head of the screw going down through the threaded cylinder and the notch on the knob that aligns with the adhesive key notation ring that is attached to the guitars body.
Figure 3E:
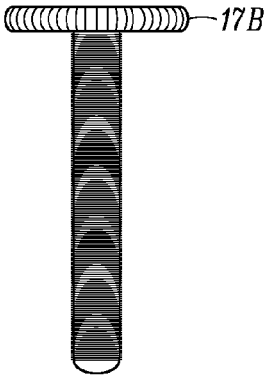
FIG. 3E illustrates another height adjustment knob with a custom designed screw with a knob on top.
Figure 3F:
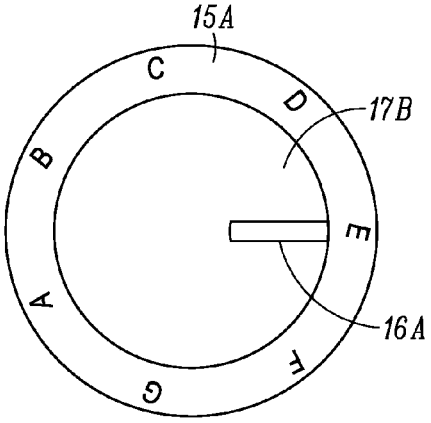
FIG. 3F illustrates a top view of the knob of FIG. 3E, showing the notch on the knob that aligns with the adhesive key notation ring that is attached to the guitars body.

These two height adjustment screws 14 (FIG. 2) can offer a similar setup as the stabilizer knob 17 (FIG. 2). Option #1 (FIG. 3C) has a center cylinder 21A that has threads on the outside. A screw 19A fits down through the knob 17A and cylinder 21A and is secured at the bottom with a lock washer 22A and nut 23A. Option #2 (FIG. 3E) has a custom knob screw made 17B to fit this design. Either option used on the adjustment knobs can have a line 16A that shows which key corresponds to the tuning at 16A (FIGS. 3D and 3F). Attached to the guitar body is an adhesive plastic key notation ring 15A. In production, when the guitar is tuned to E —440, that is when the height adjustment knobs are calibrated and marked to pitch and the plastic key notation ring is placed on the guitar body. Advantageously, these stabilizer knobs are particularly useful for players who desire alternate tunings and can be one of the added features found in top model guitars.

Figure 7:
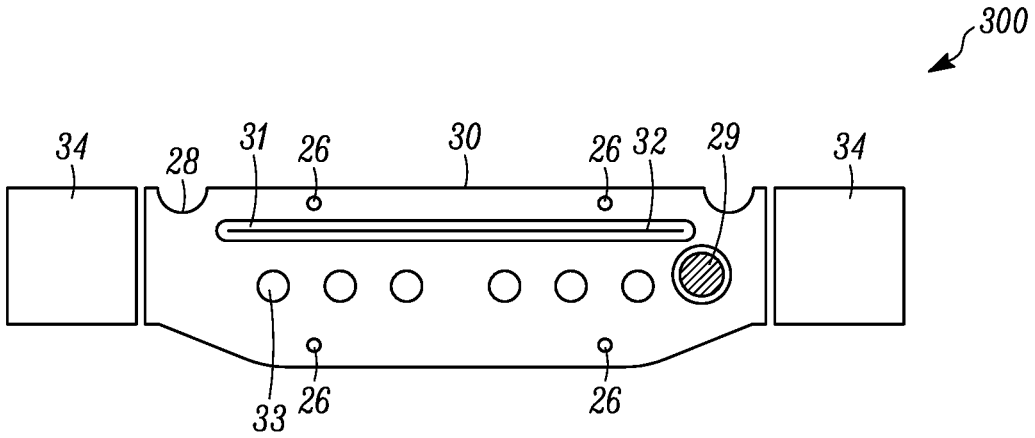
FIG. 7 illustrates a top view of the wooden bridge plate, showing the screws that hold the bridge in place, the pins that hold the strings in place, the bridge saddle, and the attached pieces on the side to give the appearance of a full bridge.
Figure 9A:
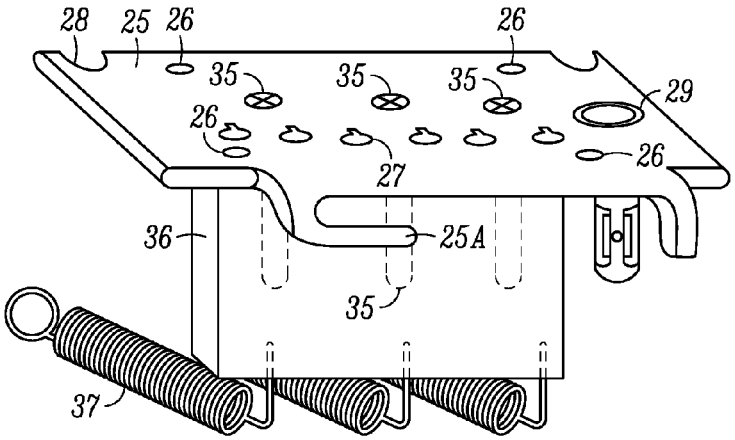
FIG. 9A illustrates a rear view of the metal bridge plate, showing how it is attached to the block and spring assembly, and showing the "C" shaped bend that accepts the arm of the stabilizer creating a fixed bridge setting when desired.
Figure 9B:
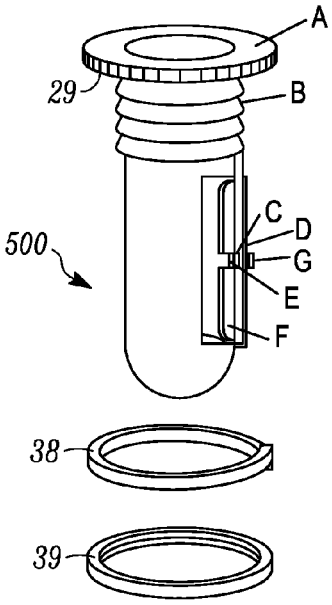
FIG. 9B illustrates the tremolo arms housing unit.
Figure 10:
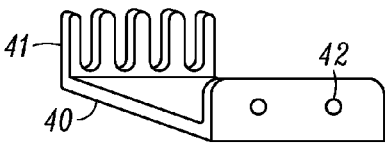
FIG. 10 illustrates a diagram showing the customized claw, showing the threaded holes that receive the Allen wrench screws that go through the face of the frame assembly and into the claw to secure them together.
Figure 11:
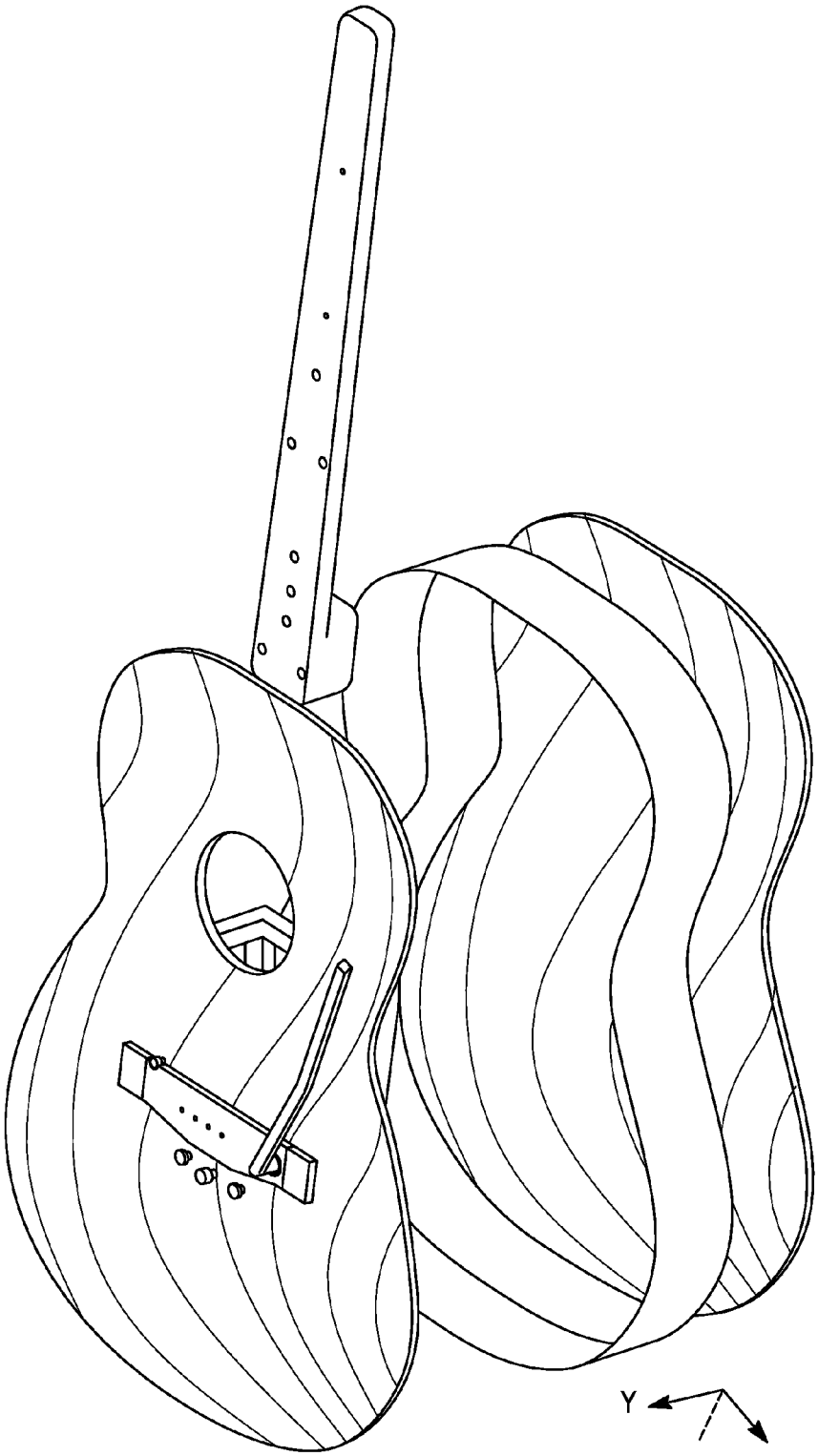
FIGS. 11-27 illustrate further views of an exemplary embodiment of the present invention.
Figure 12:
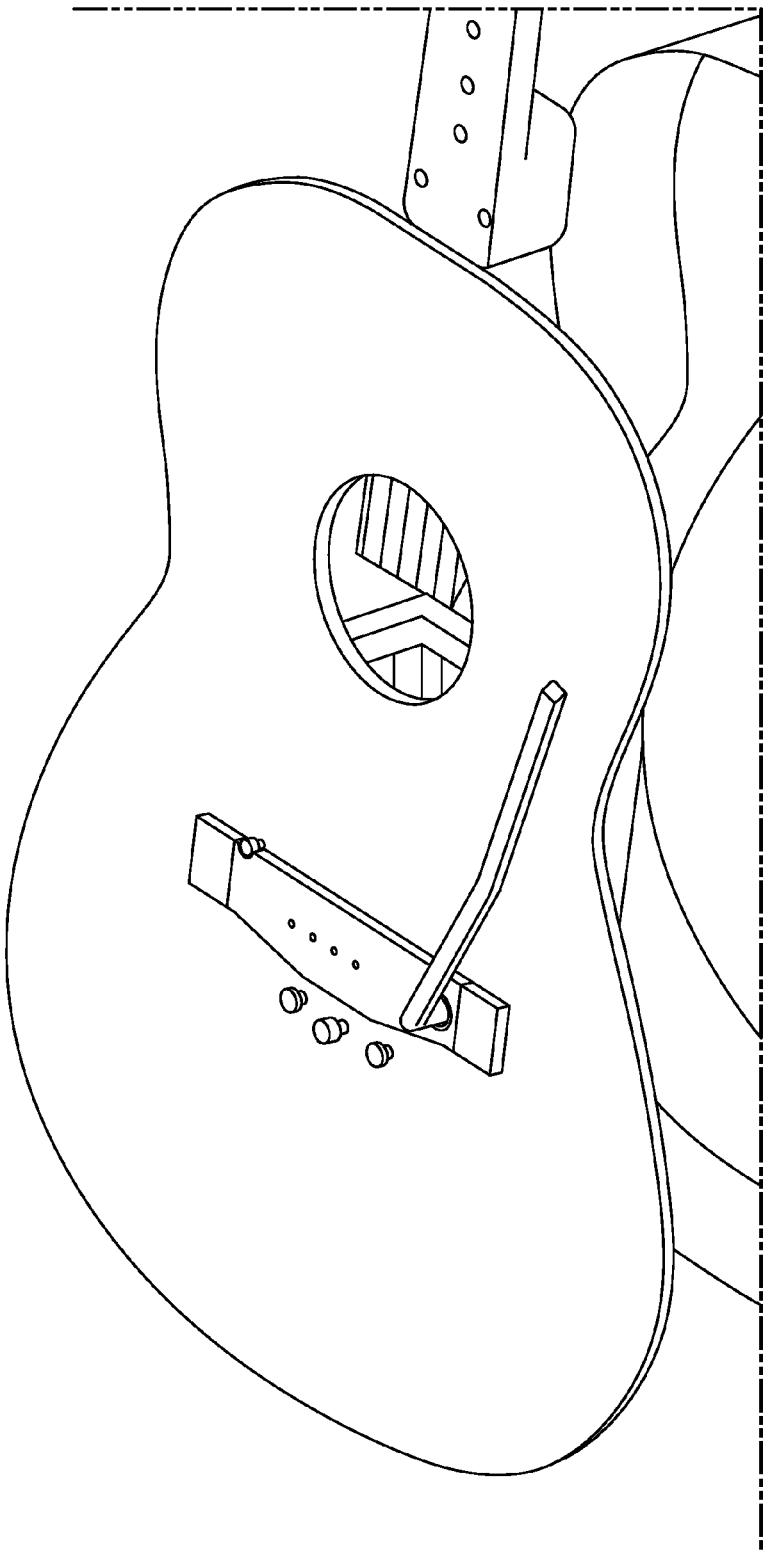
Figure 13:
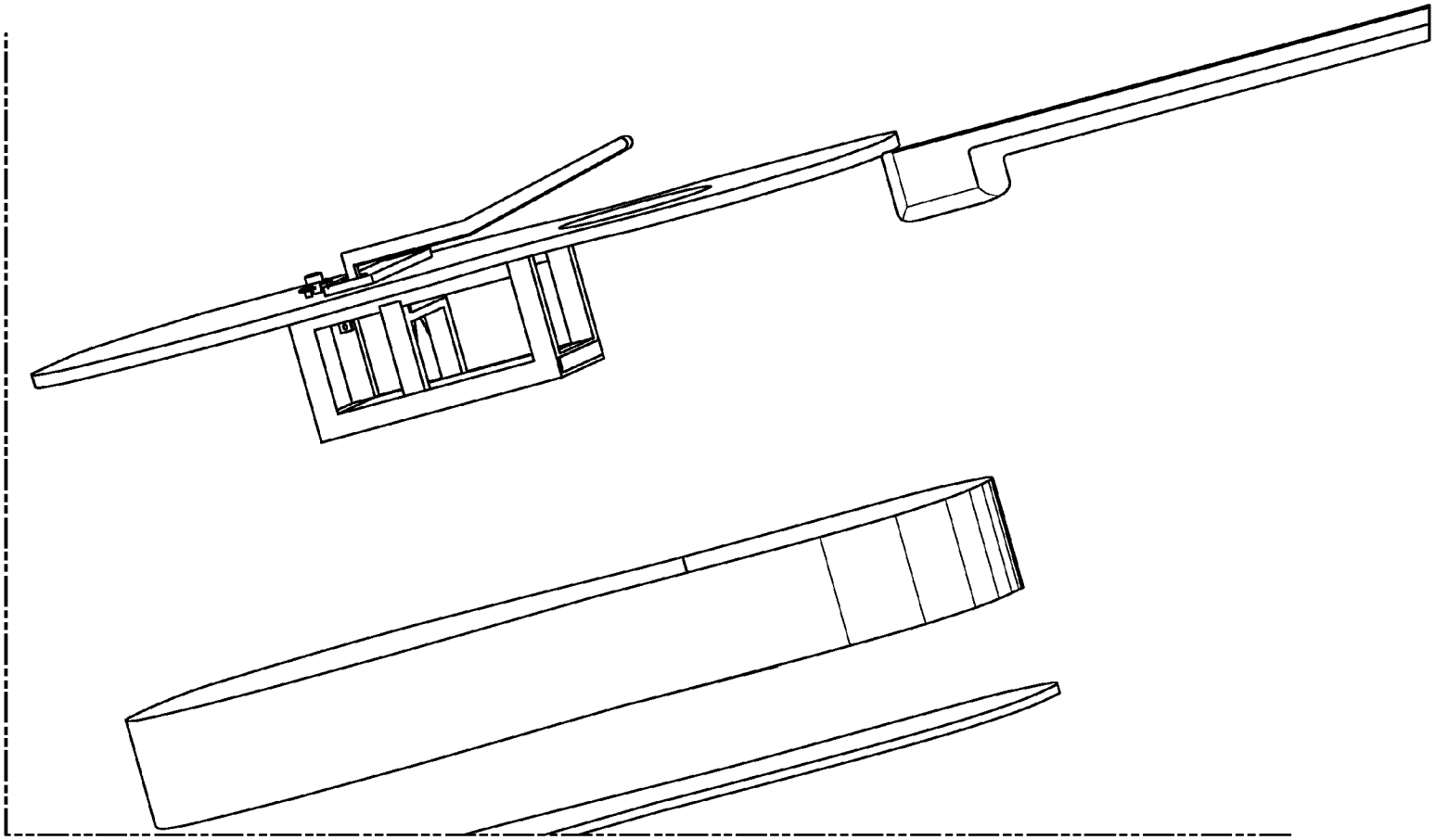
Figure 14:
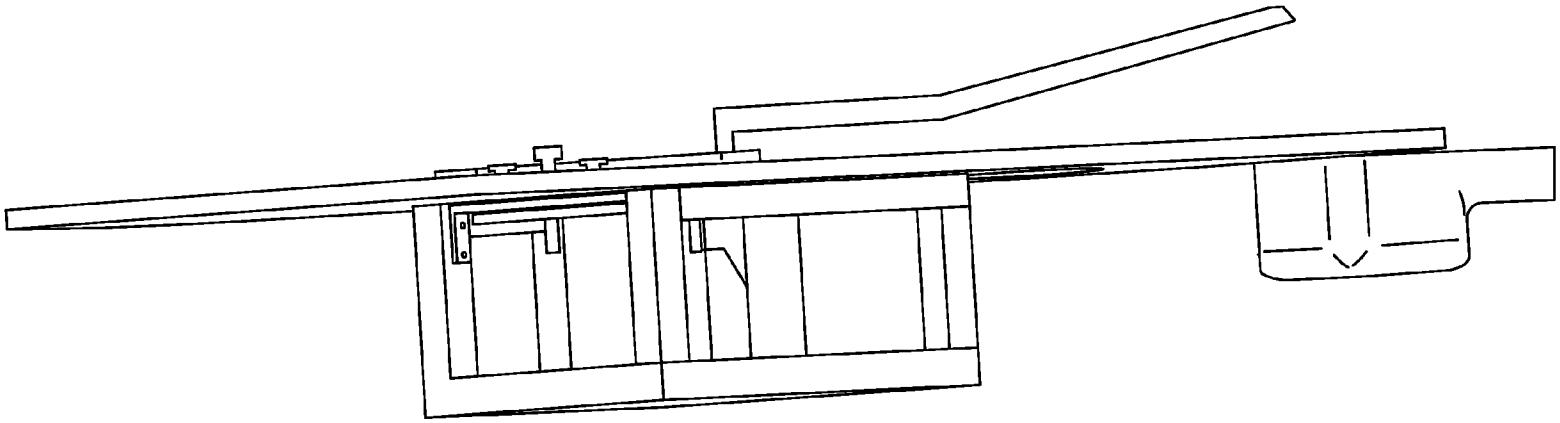
Figure 15:
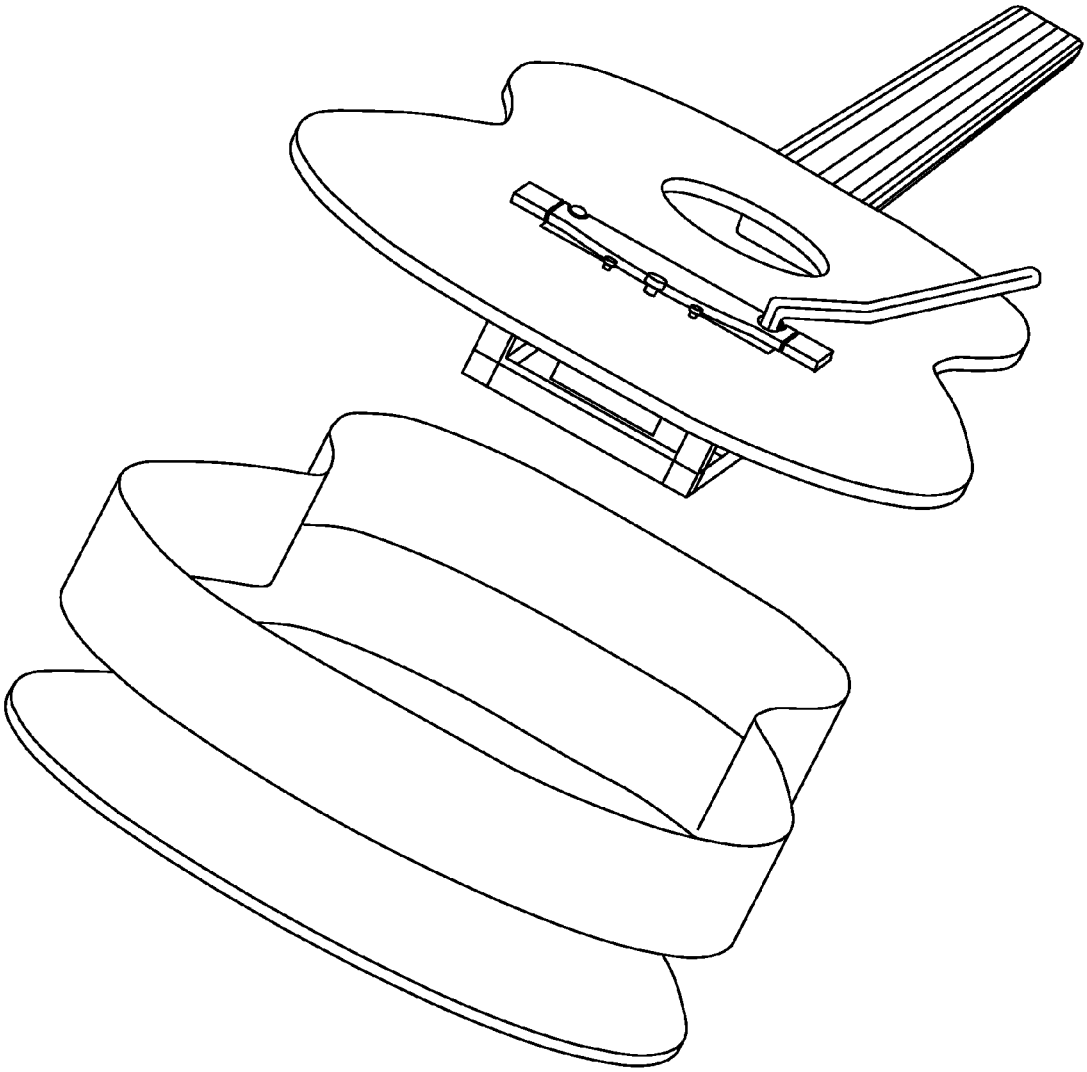
Figure 16:
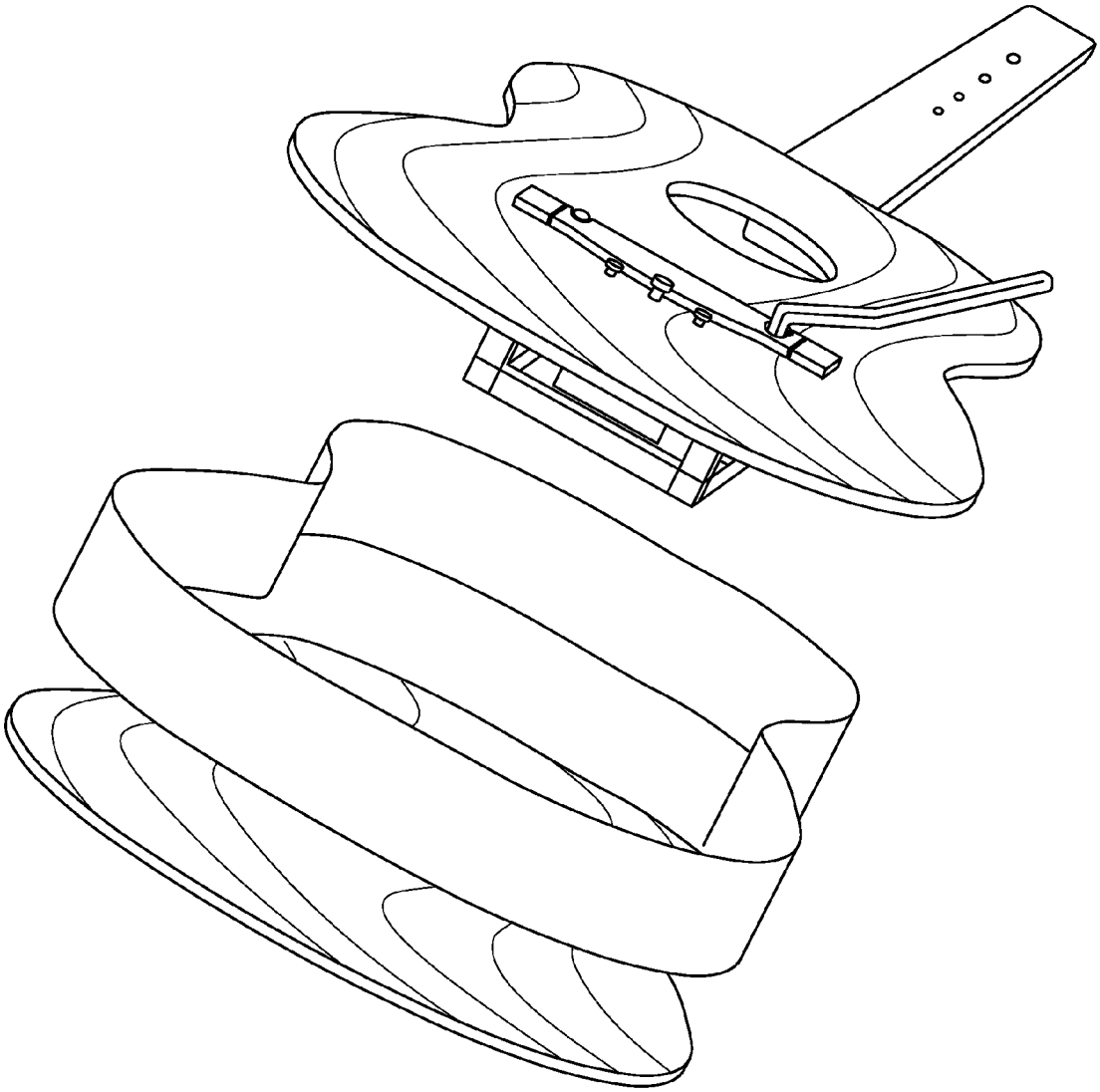
Figure 17:
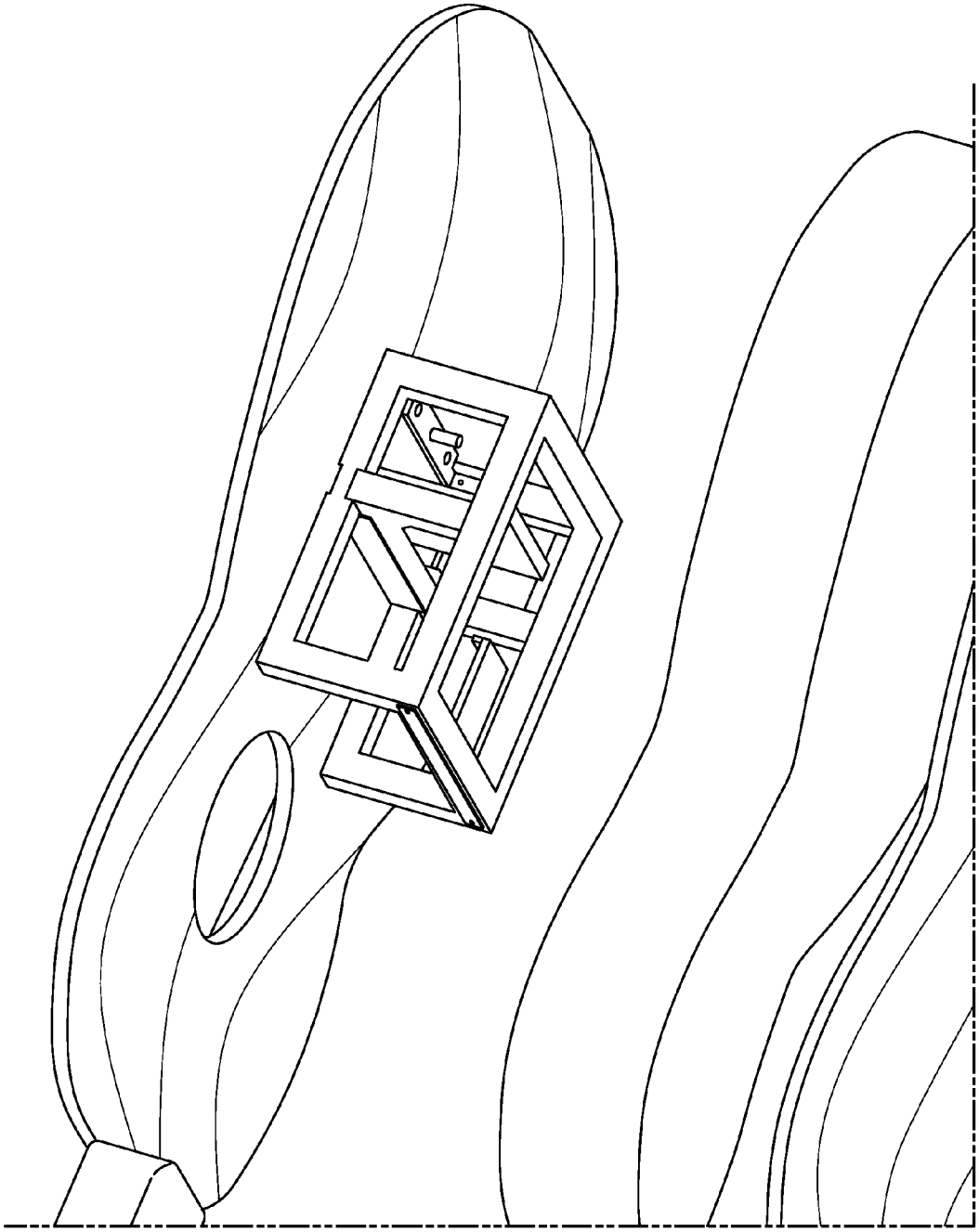
Figure 18:
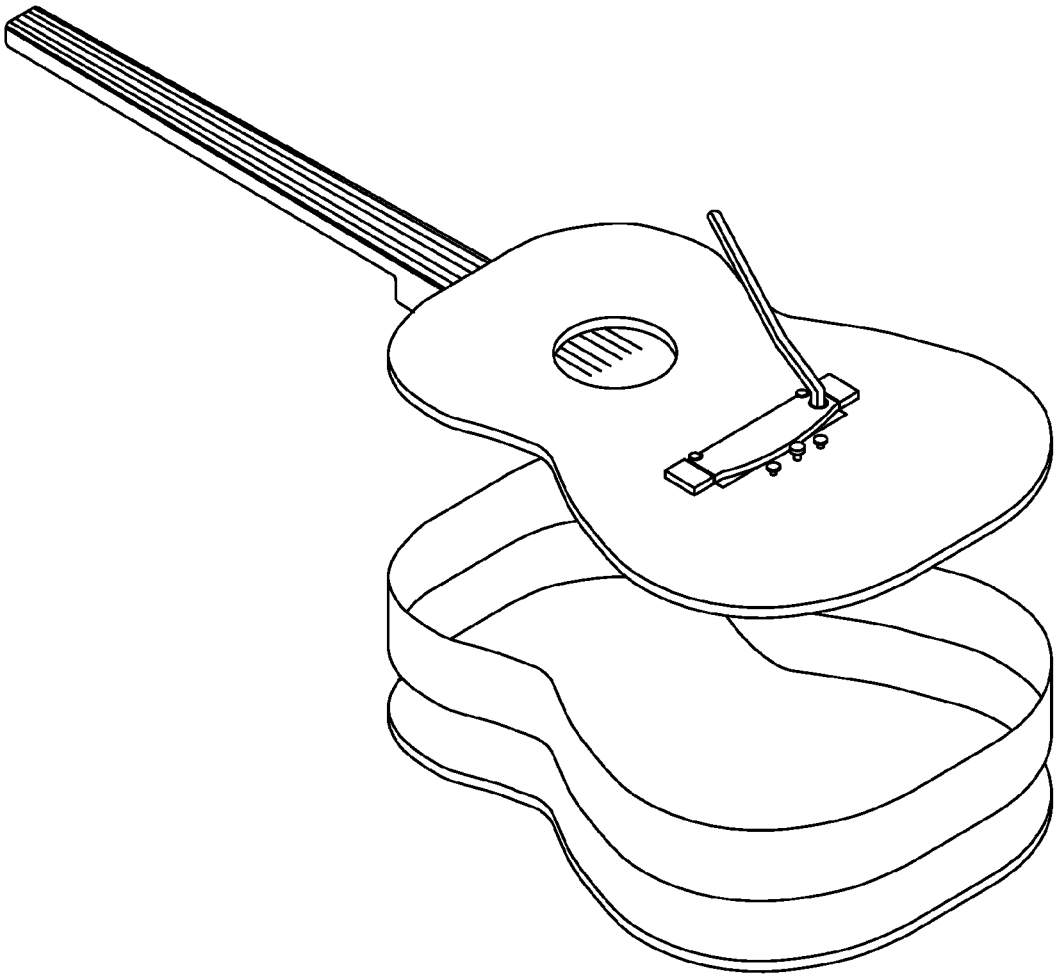
Figure 19:
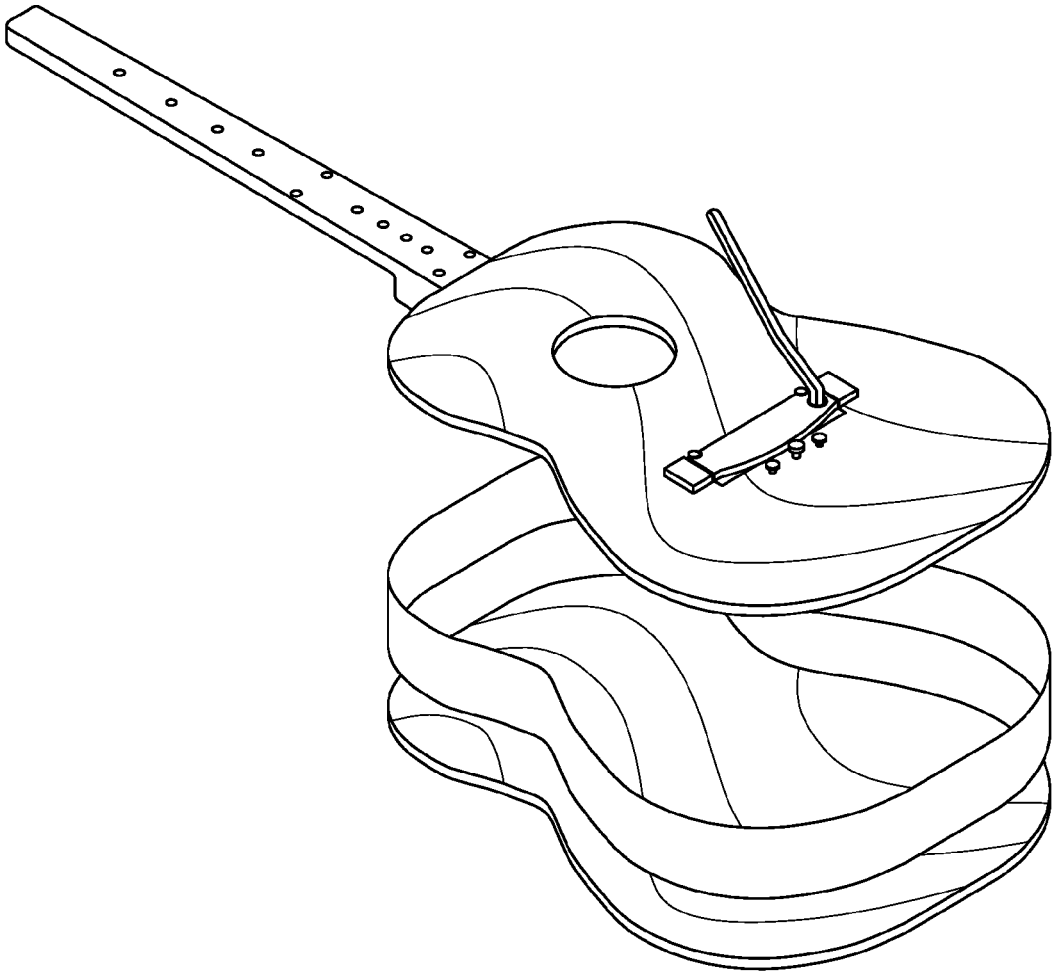
Figure 20:
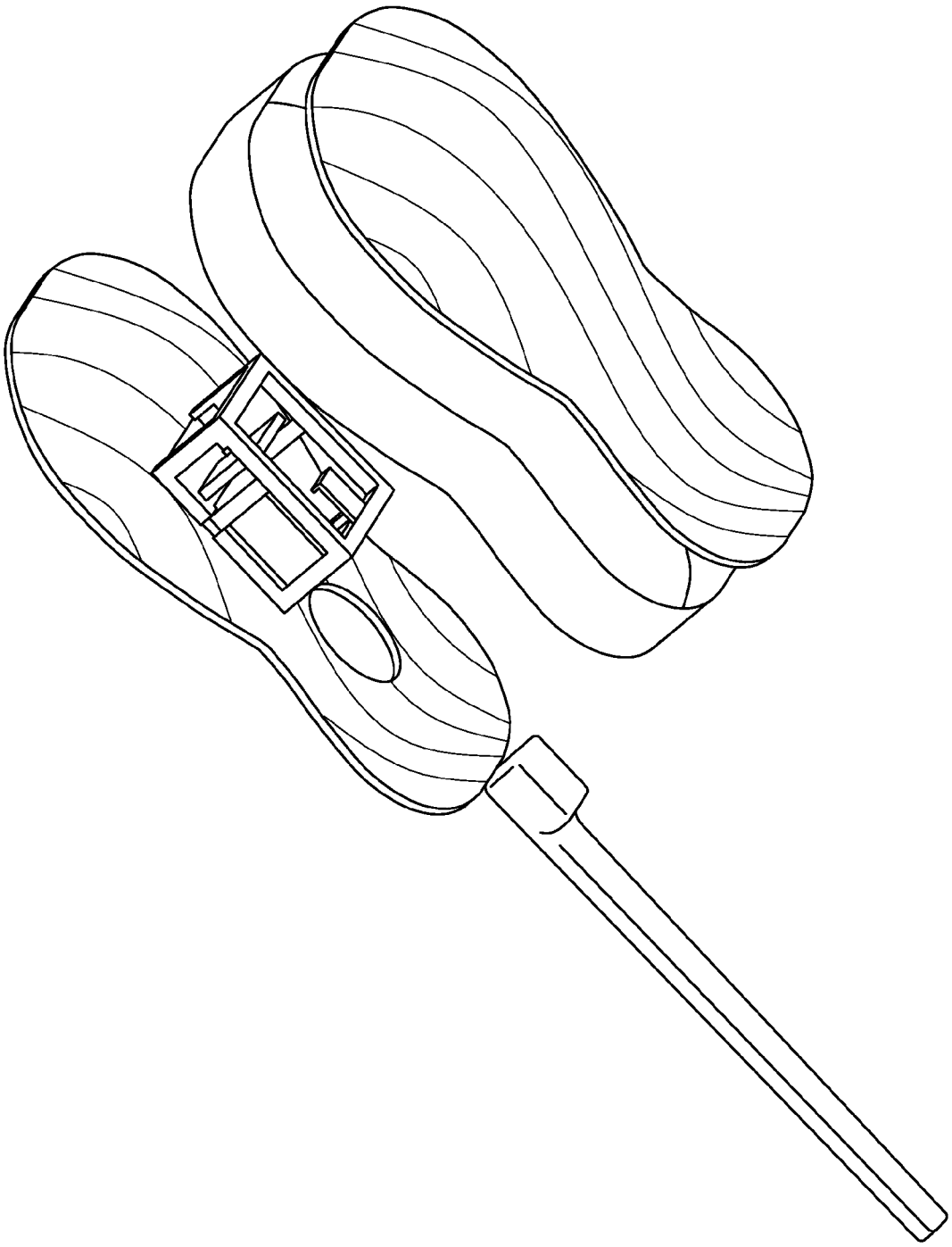
Figure 21:
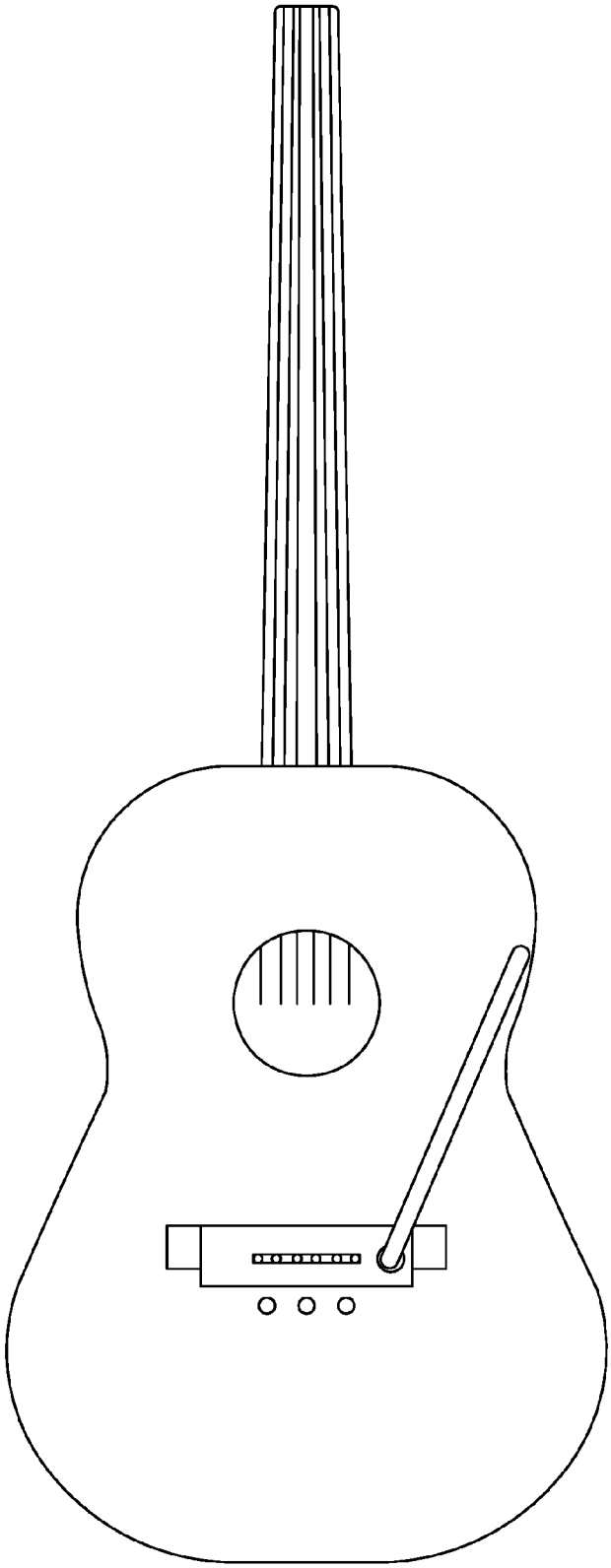
Figure 22:
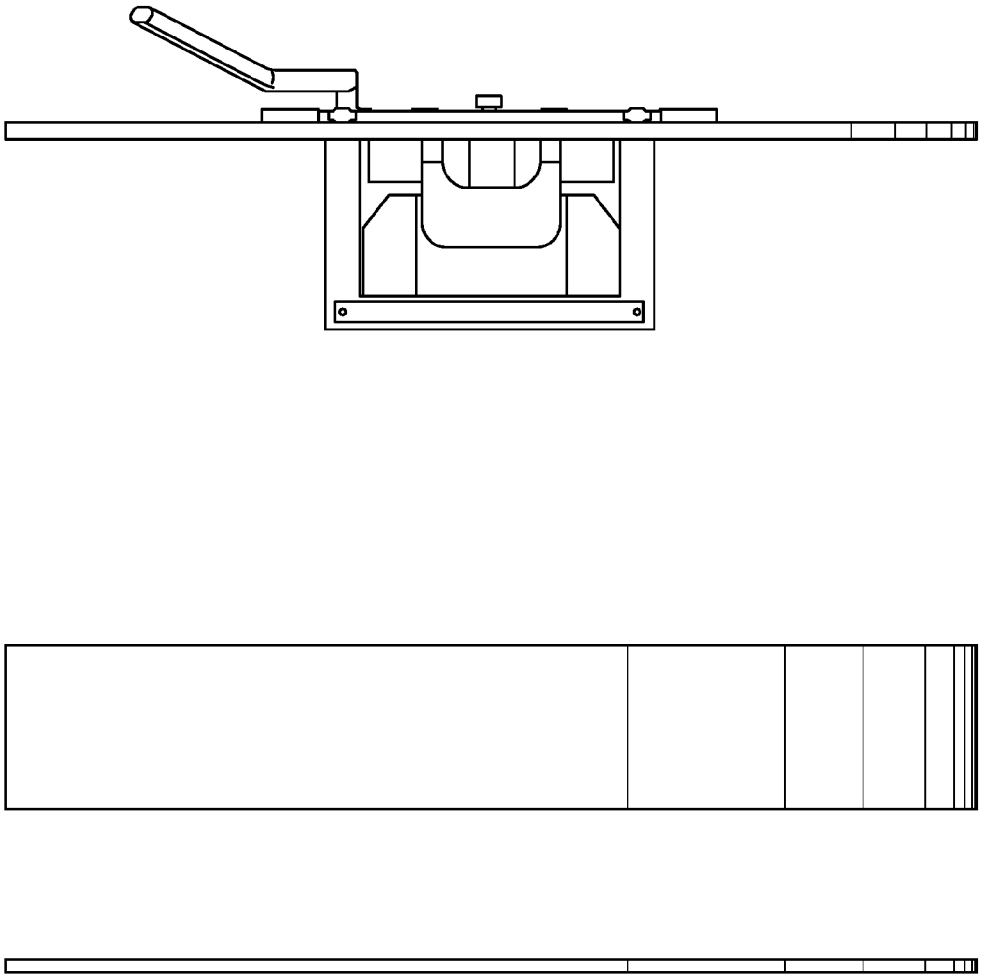
Figure 23:
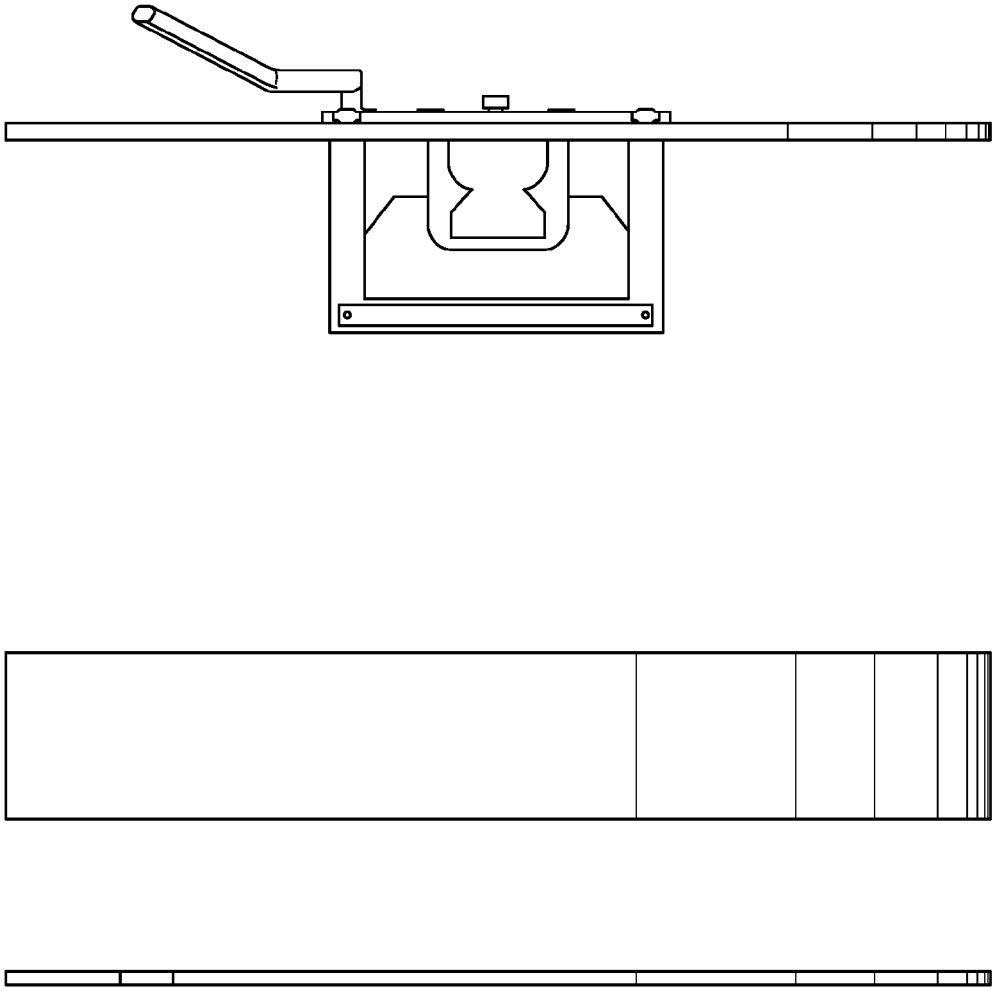
Figure 24:
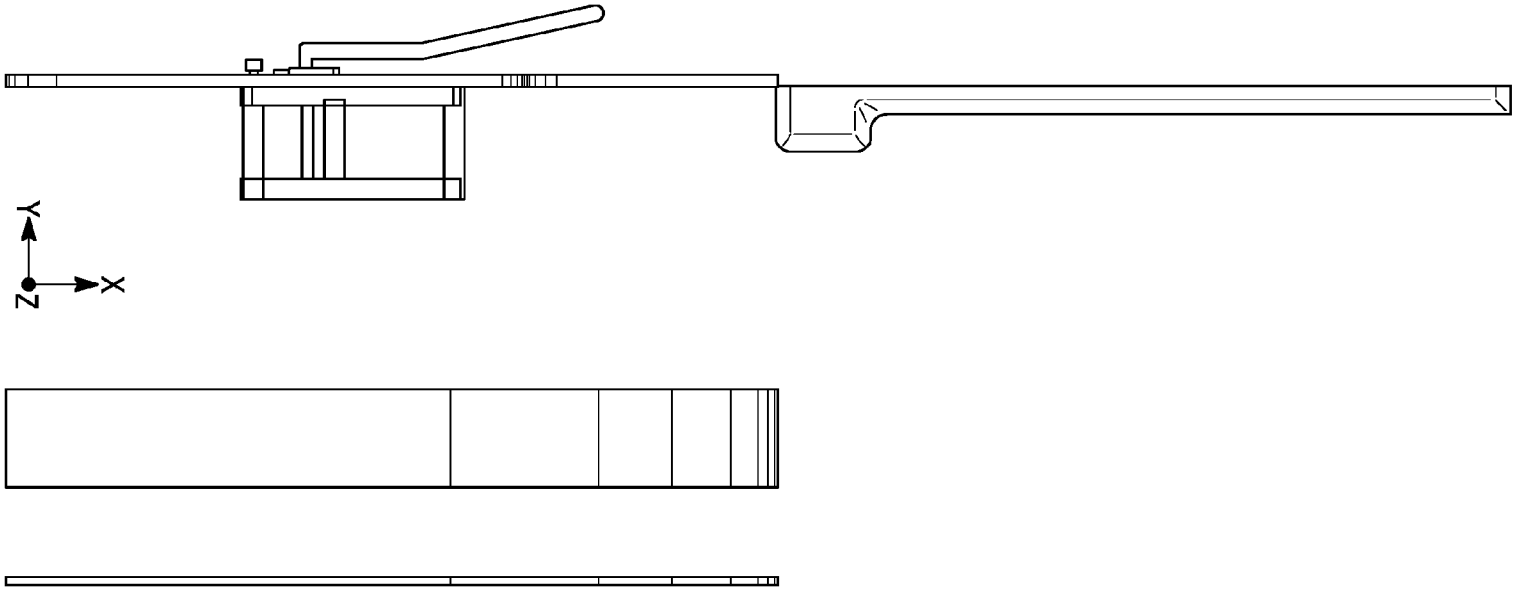
Figure 25:
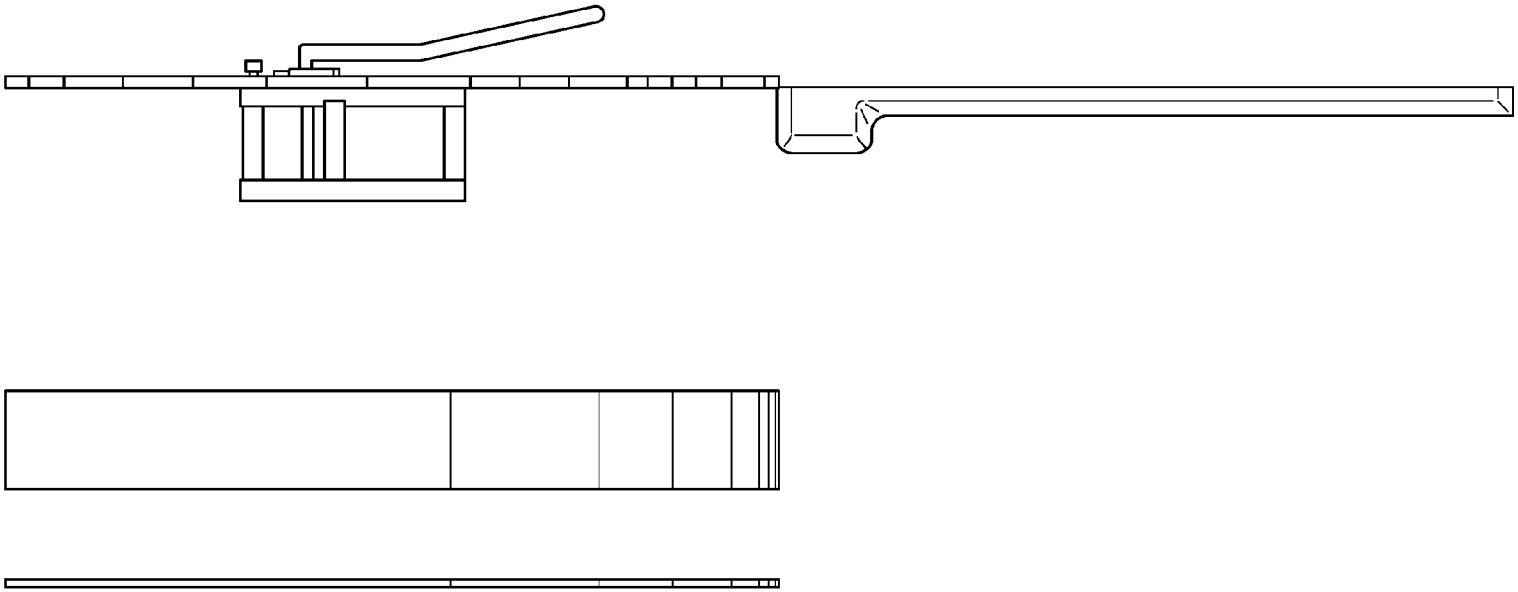
Figure 26:
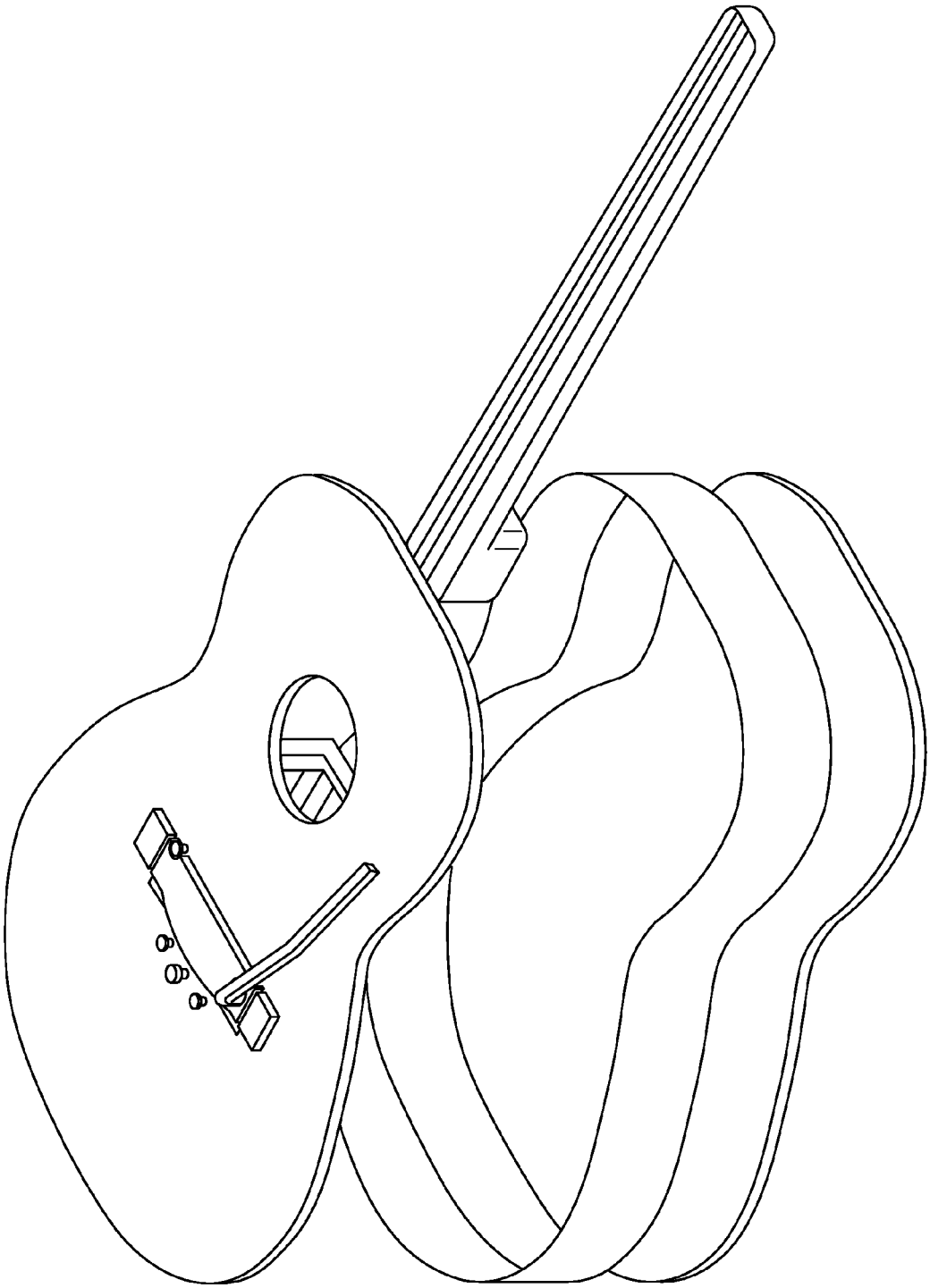
Figure 27:
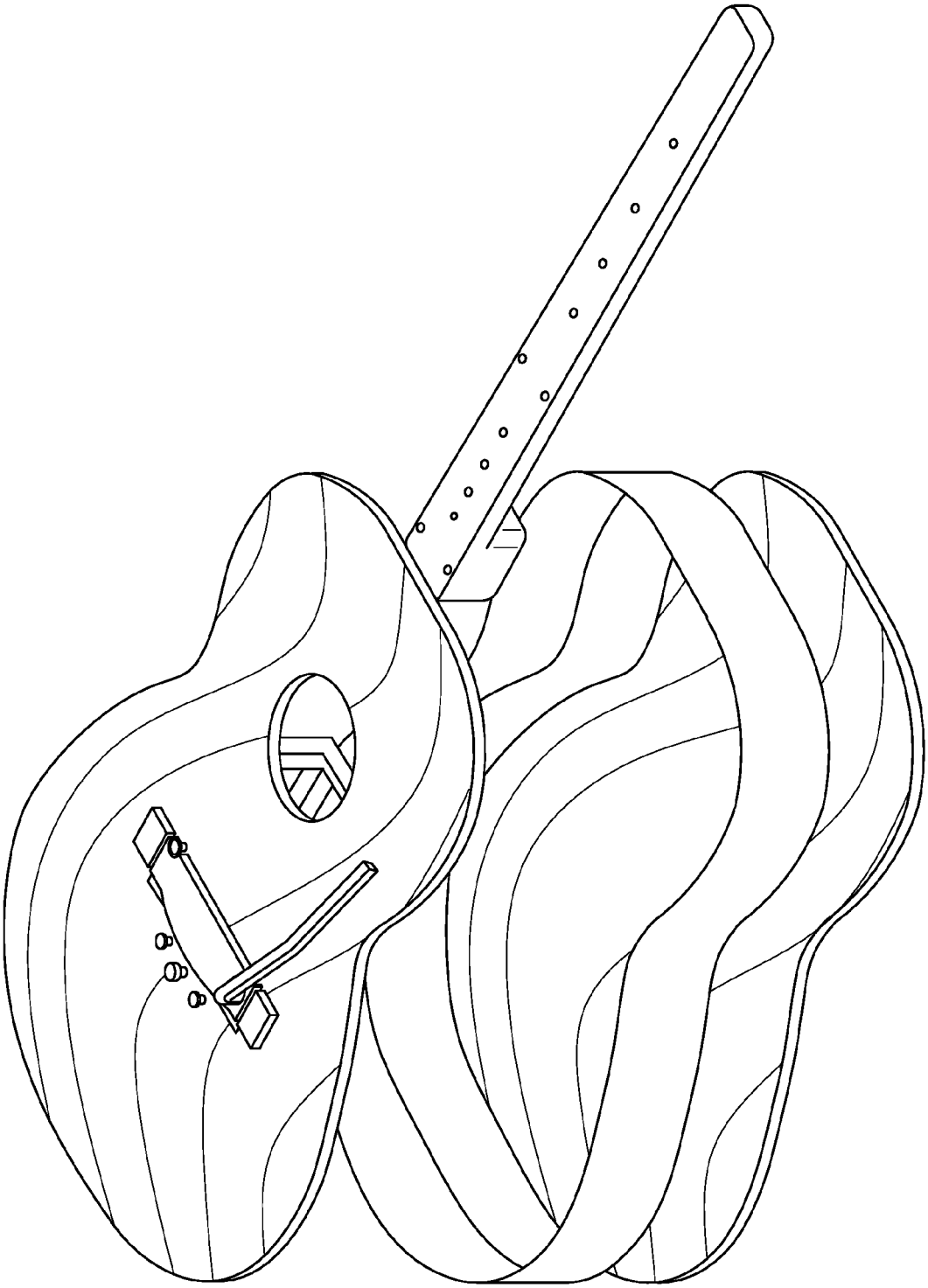

The bridge 300, shown in FIGS. 7-9, can include two pieces. The top wooden bridge plate 30 (FIG. 7) and the bottom metal bridge plate 25 (FIG. 8). The bottom metal bridge plate 25 (FIG. 8) is attached to the block 36 (FIG. 9A) by three screws 35 (FIGS. 8, 9A). These screws 35 go down through the metal bridge plate 25 (FIG. 8) to secure to the block 36 (FIG. 9A) that houses the springs 37 (FIG. 9A) underneath. The circle end of the springs 37 attach to the teeth 41 (FIG. 10) of the claw 40. The claw 40 is attached to the inside front of the structure through holes 11 (FIG. 1C), and thread into the claw 42 (FIG. 10) to adjust the tension of the springs 37 (FIG. 9A). Adjustments to the springs 37 in the tremolo device may be accomplished by using an Allen wrench through the sound hole. Advantageously, more accurate bridge tension settings are more easily accomplished, and adjustments do not have to be made through the back of the acoustic. A removable panel can be included on the back of the guitar for maintenance purposes.

Underneath the bottom metal bridge plate 25 (FIG. 9A) on the left side, the metal is bent at a 45-degree angle to create a slot 25A so that the stabilizer arm 18 slides into when a fixed bridge setting is desired. The string holes 27 (FIG. 8) allow attachment of the strings. The ball end of the strings fit into the respective slots 600 and are anchored underneath. The pins 33 (FIG. 7) slide down through the bridge 300 to secure the strings in place. Once anchored, the strings set on top of the bridge saddle 31 (FIG. 7) and are stretched up to attach to the tuning pegs. Advantageously, Sperzel locking tuners and a LSR roller nut can be used to ensure no slippage in the strings when the tremolo system is in use.

Slanted crescent moon cuts 28 (FIG. 7-8) line up to the pivots 24 (FIG. 5) on both the metal bridge plate 25 (FIG. 8) and wooden bridge plate 30 (FIG. 7), holding the bridge 300 in place. In FIG. 7, a thin line acoustic pickup 32 is shown. The Fishman Matrix acoustic pickup can be used for optimal performance. The wooden bridge plate 30 (FIG. 7) aligns over the top of the metal bridge plate 25 (FIG. 8) and is held down by four threaded screws 26 (FIG. 7) that go through the metal bridge plate 25. The side pieces 34 (FIG. 7) of the bridge 300 are separate end pieces that are glued to the body to give the appearance of a traditional full bridge.

The tremolo bar 400 goes down through the wooden bridge plate 30 (FIG. 7) and pops into the socket 29 (FIG. 9A) of the housing 400 in the metal bridge plate 25 (FIG. 9A). The socket 29 (FIG. 9B) is screwed into the metal bridge plate 25 by the following means. The top lip A of the tremolo-housing unit is put down through the metal bridge plate 25 creating stoppage for the socket. A lock washer 38 fits in under the top lip A and a threaded ring 39 fits in behind the lock washer that is tightened down on the housing units threads B to ensure the housing unit does not come loose. The threaded wall D of the recessed area of the housing unit is where the screw G is received. The little plastic piece F is recessed in the middle to allow the nut E to set flush. The high-tension spring C lies between the wall D and the contact piece F to give the desired tension to the tremolo bar 400 and hold the arm in place. When the tremolo bar 400 is inserted into the housing unit, the spring-loaded piece C creates the constant tension so the bar is in stable engagement with the bridge 300.

FIGS. 11-27 provide additional views of the features of an exemplary embodiment of the present invention described herein.

Embodiments of the present invention can be completely assembled prior to installing in the body of the guitar. Each unit can be designed to fit any suitable style of acoustic guitar depending on the guitars thickness of the body. In the design of the exemplary embodiments, different dimensions can be used but the exemplary designs shown within the present disclosure can be most effective.

Although the exemplary support frame 100 is described in terms of being rectangular, structures other than rectangular structures can be employed, as will be appreciated by those skilled in the guitar art(s). Although the exemplary embodiments are described in terms of using wood, other materials can be employed, such as plastic, composite materials, or the like, as will be appreciated by those skilled in the guitar art(s). Moreover, the exemplary embodiments use glue and dowel rods but the present invention can use other suitable materials or devices for fastening parts of the invention. Any suitable materials or devices can be used as long as it preserves the natural acoustic resonance qualities of the acoustic guitar.

Advantageously, the various features of the exemplary tremolo system can be used with existing electric guitar tremolo systems. For example, the stabilizer unit 200 (FIG. 2) can be screwed into the body of electric tremolo systems behind the bridge in its own routed area within the body. The stabilizer 200 can be installed prior to the top laminated piece being added. Another feature of this present invention that can apply to electric guitars is housing socket 29 (FIGS. 9A-9B), which creates a socket for the tremolo bar 400. Advantageously, the housing unit 29 can be universally applied to other tremolo bar-housing units.

While the present inventions have been described in connection with a number of exemplary embodiments, and implementations, the present inventions are not so limited, but rather cover various modifications, and equivalent arrangements, which fall within the purview of the appended claims.

What is claimed is:

1. A bridge device to hold strings of a musical instrument in tension, said device comprising:

a top wooden plate having a plurality of circular openings to accept ball-ends of strings through a top portion thereof;

a metal plate underlying said top wooden plate and comprising:

a respective plurality of string holding portions corresponding to said circular openings of said top wooden plate;

said string holding portions having a bottom surface and a top surface;

wherein said string holding portions are shaped to have circular openings with adjoining slots in a same plane as said circular openings;

wherein a width of said slots are configured to receive a string width of each of said strings in tension;

wherein a diameter of said circular openings are configured to receive said ball-ends of said strings in tension through said top surface;

wherein said ball-ends engage said bottom surface of said string holding portions and said ball-ends are held in place by said slots;

wherein said musical instrument has an internal cavity, and wherein said bridge device is positioned over a body opening in said musical instrument;

wherein a first edge of said bridge device pivots at a side of said body opening and a second edge of said bridge device moves in and out of said internal cavity to change said tension of said string;

wherein said bridge device pivots at one or more pivot posts;

wherein said one or more pivot posts engage a support frame; and wherein said bridge device comprises a wooden surface with an underlying metal plate.

2. The bridge device according to claim 1, wherein said musical instrument is an acoustic guitar.

3. The bridge device according to claim 1, further comprising springs adapted to be attached between said support frame and said bridge device.

* * * * *